US009093079B2

(12) United States Patent
Kleffner et al.

(10) Patent No.: US 9,093,079 B2
(45) Date of Patent: Jul. 28, 2015

(54) METHOD AND APPARATUS FOR BLIND SIGNAL RECOVERY IN NOISY, REVERBERANT ENVIRONMENTS

(75) Inventors: Matthew D. Kleffner, Eden Prairie, MN (US); Douglas L. Jones, Champaign, IL (US)

(73) Assignee: Board of Trustees of the University of Illinois, Urbana, IL (US)

( * ) Notice: Subject to any disclaimer, the term of this patent is extended or adjusted under 35 U.S.C. 154(b) by 1208 days.

(21) Appl. No.: 12/963,877

(22) Filed: Dec. 9, 2010

(65) Prior Publication Data

US 2011/0231185 A1 Sep. 22, 2011

Related U.S. Application Data

(63) Continuation of application No. PCT/US2009/003469, filed on Jun. 9, 2009.

(60) Provisional application No. 61/131,467, filed on Jun. 9, 2008.

(51) Int. Cl.

| | |
|---|---|
| ***G10L 21/0208*** | (2013.01) |
| ***G10L 21/0272*** | (2013.01) |
| ***G10L 21/028*** | (2013.01) |
| *G10L 21/0216* | (2013.01) |

(52) U.S. Cl.

CPC ..... *G10L 21/0272* (2013.01); *G10L 21/0216* (2013.01); *G10L 2021/02166* (2013.01)

(58) Field of Classification Search

CPC . G10L 21/02; G10L 21/0216; G10L 21/0232; G10L 21/0272; G10L 21/028; G10L 21/0308; G10L 2021/02166

USPC ..... 704/206, 233; 381/71.1, 71.4

See application file for complete search history.

(56) References Cited

U.S. PATENT DOCUMENTS

| | | | |
|---|---|---|---|
| 5,210,820 | A | 5/1993 | Kenyon |
| 5,706,402 | A | 1/1998 | Bell |

(Continued)

FOREIGN PATENT DOCUMENTS

| | | | |
|---|---|---|---|
| JP | 2008-026625 | A | 2/2008 |
| KR | 10-2006-0085392 | A | 7/2006 |

(Continued)

OTHER PUBLICATIONS

"Schedule for the 153rd Meeting: Acoustical Society of America," Journal of the Acoustic Society of America, vol. 121, No. 5, Pt. 2, May 2007, pp. 3151-3192.*

(Continued)

*Primary Examiner* — James Wozniak
(74) *Attorney, Agent, or Firm* — Krieg DeVault LLP

(57) ABSTRACT

A maximum-kurtosis, distortionless response (MKDR) technique and an extension, the maximum-kurtosis, Wiener estimate (MKWE) technique, are provided. In one form, blind estimates of the speech source's channel response are made from the microphone data and MVDR is applied. The source direction is estimated by finding weights that maximize output kurtosis, or the fourth central statistical moment, in the frequency domain. The MKWE approach approximates the Wiener filter by using MKDR-output noise power estimates to compute a Wiener post-filter. These approaches can be extended to block-adaptive versions if the speech source is not quickly moving in space.

29 Claims, 13 Drawing Sheets

(56) References Cited

U.S. PATENT DOCUMENTS

| | | | | |
|---|---|---|---|---|
| 6,978,159 | B2 | 12/2005 | Feng et al. | |
| 6,983,264 | B2 | 1/2006 | Shimizu | |
| 7,076,072 | B2 | 7/2006 | Feng et al. | |
| 7,079,988 | B2 | 7/2006 | Albera et al. | |
| 7,167,568 | B2 * | 1/2007 | Malvar et al. | 381/66 |
| 7,231,346 | B2 * | 6/2007 | Yamato et al. | 704/233 |
| 8,630,685 | B2 * | 1/2014 | Schrage | 455/570 |
| 2003/0063759 | A1 * | 4/2003 | Brennan et al. | 381/92 |
| 2006/0262865 | A1 | 11/2006 | Moran | |
| 2007/0038442 | A1 * | 2/2007 | Visser et al. | 704/233 |
| 2007/0055511 | A1 | 3/2007 | Gotanda et al. | |
| 2007/0100615 | A1 * | 5/2007 | Gotanda et al. | 704/226 |
| 2007/0185705 | A1 * | 8/2007 | Hiroe | 704/200 |
| 2008/0208538 | A1 * | 8/2008 | Visser et al. | 702/190 |
| 2009/0164212 | A1 * | 6/2009 | Chan et al. | 704/226 |
| 2009/0220107 | A1 * | 9/2009 | Every et al. | 381/94.7 |
| 2010/0022280 | A1 * | 1/2010 | Schrage | 455/567 |

FOREIGN PATENT DOCUMENTS

| | | | | |
|---|---|---|---|---|
| WO | WO 01/87011 | A2 | 11/2001 | |
| WO | WO 2006/082868 | A2 | 8/2006 | |
| WO | WO 2006/135986 | A1 | 12/2006 | |
| WO | WO 2007/140799 | A1 | 12/2007 | |
| WO | WO 2007140799 | A1 * | 12/2007 | G10L 21/02 |
| WO | WO 2009/151578 | A3 | 12/2009 | |

OTHER PUBLICATIONS

Kleffner, et al. "Preatical Kurtosis-based Blind Recovery of a Speech Source in Real-world Noise," Journal of the Acoustic Society of America, vol. 121, No. 5, Pt. 2, May 2007, p. 3184.*

Low, Siow Yong, et al. "Convolutive blind signal separation with post-processing." Speech and Audio Processing, IEEE Transactions on 12.5, Sep. 2004, pp. 539-548.*

Low, Siow Yong, et al. "Spatio-temporal processing for distant speech recognition." Acoustics, Speech, and Signal Processing, 2004. Proceedings.(ICASSP'04). IEEE International Conference on. vol. 1. IEEE, May 2004, pp. 1-4.*

Nordholm, et al. "Speech signal extraction utilizing PCA-ICA algorithm with a non-uniform spacing microphone array." Acoustics, Speech and Signal Processing, 2006. ICASSP 2006 Proceedings. 2006 IEEE International Conference on. vol. 5. IEEE, May 2006. pp. 965-968.*

Yermeche, et al. "Blind subband beamforming with time-delay constraints for moving source speech enhancement." Audio, Speech, and Language Processing, IEEE Transactions on 15.8, Nov. 2007, pp. 2360-2372.*

Raub, et al. "A cepstral domain maximum likelihod beamformer for speech recognition." Interspeech. 2004, pp. 1-4.*

Sällberg, Benny, et al. "Real-time implementation of a blind beamformer for subband speech enhancement using kurtosis maximization." International Workshop on Acoustics, Echo and Noise Control. 2006, pp. 1-4.*

Saruwatari, Hiroshi, et al. "Speech enhancement using nonlinear microphone array based on noise adaptive complementary beamforming." IEICE transactions on fundamentals of electronics, communications and computer sciences 83.5, Jan. 1999, pp. 1-11.*

Low, Siow Yong, et al. "A blind approach to joint noise and acoustic echo cancellation." Acoustics, Speech, and Signal Processing, 2005. Proceedings.(ICASSP'05). IEEE International Conference on. vol. 3. IEEE, Mar. 2005, pp. 69-72.*

Yang, Kehu, et al. "Super-exponential blind adaptive beamforming." Signal Processing, IEEE Transactions on 52.6, Jun. 204, pp. 1549-1563.*

Siow et al.; A Hybrid Speech Enhancement System Employing Blind Source Separation and Adaptive Noise Cancellation; NORSIG 2004, Jun. 2004, pp. 204-207.

International Search Report, WO 2009/15178 A3, Dec. 17, 2009, The Board of Trustees of the University of Illinois.

Blind Recovery of a Speech Source in Noisy, Reverberant Environments, Kleffner, et al., Department of Electrical and Computer Engineering, University of Illinois at Urbana-Champain, Nov. 1, 2007.

Speech Separation by Kurtosis Maximization, LeBlanc, et al., Klipsh School of ECE.

Kleffner, Matthew D., Jones, Douglas L., Practical Kurtosis-Based Blind Recovery of a Speech Source in Real-World Noise, pp. 1, University of Illinois at Urbana-Champaign, Jun. 2007.

* cited by examiner

* Kurtosis algorithm signal-to=interference ratio (SIR) gain exceeds known-SV MVDR gain

* Kurtosis steering vector mismatch can increase SIR gain

METHOD AND APPARATUS FOR BLIND SIGNAL RECOVERY IN NOISY, REVERBERANT ENVIRONMENTS

CROSS-REFERENCE TO RELATED APPLICATIONS

The present application is a continuation of International Patent Application No. PCT/US2009/003469, filed on Jun. 9, 2009, which claims the benefit of U.S. Provisional Patent Application No. 61/131,467, filed on Jun. 9, 2008, both of which are hereby incorporated by reference in their entirety.

GOVERNMENT RIGHTS

The present invention was made with Government assistance under National Science Foundation (NSF) Grant Contract Number CCF 03-12432. The Government has certain rights in this invention.

BACKGROUND

The present application relates to signal processing, and more specifically, but not exclusively, relates to the recovery of speech in noisy environments.

In many multi-sensor, single-source applications noise interferes with recovering a desired speech signal from its source. Various approaches have been designed to recover sources in interference, but most of them require prior knowledge or assumptions that limit their applicability to real-world environments. Single-channel noise reduction techniques have been applied to the speech enhancement problem, one of the most common being spectral subtraction. See J. Lim and A. Oppenheim, *Enhancement and bandwidth compression of noisy speech*, Proc. of the IEEE 67, 1586-1604 (1979). Spectral subtraction reduces noise levels given estimates of the noise power spectrum and speech uncorrelated to the noise; it can be effective in reducing listener fatigue, but it has not been shown to increase intelligibility. Single-source de-noising methods rely on the existence of a basis where thresholds can be used to discard or modify noisy basis elements. See D. Donoho, *De-noising by soft-thresholding*, IEEE Trans. Info. Theory 41, 613-627 (1995).

Multiple-microphone approaches can offer speech-enhancement advantages over single-microphone methods. One such category of approaches to speech recovery in noise is beamforming. See S. Haykin, *Adaptive Filter Theory*, Third Edition (Prentice Hall, Upper Saddle River, N.J.) (1996). Fixed beamforming requires many microphones and prior knowledge or estimation of the desired source location. Beamformers such as the Minimum Variance Distortionless Response (MVDR) [See J. Capon, *High-resolution frequency-wavenumber spectrum analysis*, Proc. of the IEEE 57, 1408-1418 (1969)] beamformer require knowledge of the desired source-to-microphone channel response or a parametric representation of the response, which is often impractical in real-world applications, especially in reverberent environments. If minimum mean-squared error is desired, then the Wiener beamformer can be computed. However, the Wiener beamformer requires knowledge of the time-varying, cross-spectral densities of the speech and interference. An adaptive frequency-domain MVDR technique that accounts for non-stationarity of typical sources can also be applied, resulting in performance superior to standard beamforming approaches for such sources. See Capon. However, this adaptive beamformer requires the same prior channel knowledge as the standard MVDR beamformer.

Blind source separation (BSS) techniques offer recovery of L sources from R sensor signals (typically less than or equal to R) with few known parameters. A well-researched class of approaches that relies on higher-order statistics to separate the mixtures is Independent Component Analysis (ICA) [See M. Lockwood, D. Jones, R. Bilger, C. Lansing, J. W. D. O'Brien, B. Wheeler, and A. Feng, *Performance of time-and frequency-domain binaural beamformers based on recorded signals from real rooms*, Jrnl. Acoust. Soc. Amer. 115, 379-391 (2004)]—ICA is especially well-suited when the sources are stationary and instantaneously mixed. Convolutional mixtures can be handled in the frequency domain by applying ICA individually in each frequency bin. This approach can be used in most applications if the noise is modeled as a few distinct sources. However, recovery of the noise sources is not required in most applications, and parameters that are usually unknown are required to construct the recovery filter; a complex scale factor is required in each bin to construct the recovery filter for each source, and a peiniutation matrix is required to assign separated signals in each bin to a particular source.

The permutation problem has been approached by making bin-by-bin signal-to-source assignments based on local inter-frequency correlations. See T. Lee, *Independent Component Analysis* (Kluwer Academic Publishers, Boston, Mass.) (1998). However, errors can accumulate because decisions are made locally. Nonstationarity and second-order statistics are used in a broadband method that circumvents the scaling and permutation problem [See H. Sawada, R. Mukai, S. Araki, and S. Makino, *Robust and precise method for solving the permutation problem of frequency-domain blind-source separation*, IEEE Trans. Speech and Audio Proc. 12, 530-538 (2004)], but this method is computationally expensive. Independent vector analysis (IVA) solves the permutation problem by extending ICA to directly model and exploit the dependencies among frequency components within each source. See S.-Y. L. T. Kim, H. T. Attias and T.-W. Lee, *Blind source separation exploiting higher-order frequency dependencies*, IEEE Trans. Audio, Speech, and Language Proc. 15, 70-79 (2007), See also I. Lee and T.-W. Lee, *On the assumption of spherical symmetry and sparseness for the frequency-domain speech model*, IEEE Trans. Audio, Speech, and Language Proc. 15, 1521-1528 (2007). However, all of these methods require the number of sources to be less than or equal to the number of microphones, which is impractical as noise often cannot be modeled as a small number of distinct sources.

None of these methods explicitly account for more noise sources than microphones. A combination of ICA and time-frequency masking can be used with two microphones to recover up to six sources. See M. Pederson, D. Wang, J. Larsen, and U. Kjems, *Overcomplete blind source separation by combining ICA and binary time-frequency masking*, (IEEE WORKSHOP ON MACHINE LEARNING FOR SIGNAL PROC.) 15-20 (2005). However, this approach is typically not practical when the sources are mixed instantaneously, and sparse source distribution in time or frequency is needed for good reconstruction.

Another way for ICA methods to recover speech in noise is to model the noise separately from the sources. Convolutive BSS for noisy mixtures was shown in H. Buchner, R. Aichner, and W. Kellermann, Convolutive blind source separation for noisy mixtures, (Proc. Joint Mtg. German French Acoust. Soc. (CFA/DAGA) 583-584, Strasbourg, France) (2004). While this approach may be viable for one or two speech sources in noise, it is computationally expensive and relies on sparsity in time to estimate the noise correlation matrix and remove the bias caused by the noise.

Thus, while a number of advances have been made, there remains a demand for further contributions in this area of technology.

SUMMARY

Accordingly, one embodiment of the present application is a unique technique to recover a desired signal in a noisy environment. Other embodiments include unique systems, devices, methods, and apparatus to recover a speech source amid noise as a function of kurtosis. Further embodiments, forms, features, benefits, advantages, aspects and objects of the present application and inventions therein shall become apparent from the description and figures included herewith.

DETAILED DESCRIPTION OF REPRESENTATIVE EMBODIMENTS

Figure 1:
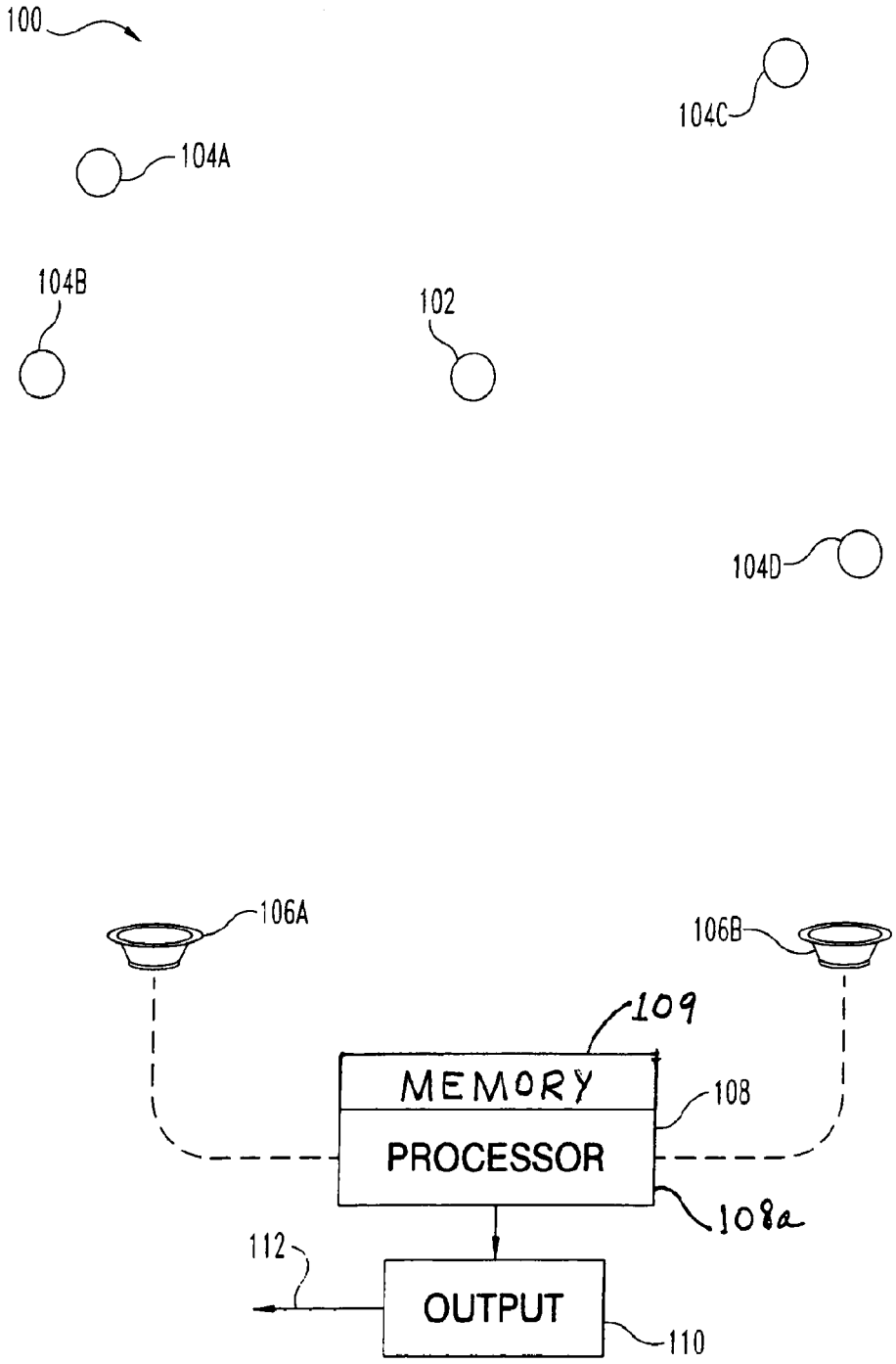
FIG. 1. is a diagrammatic illustration of a system for blind signal recovery.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the illustrated embodiments, and any further applications of the principles of the invention as illustrated therein as would normally occur to one skilled in the art to which the invention relates are contemplated and protected.

Many speech communication applications desire intelligible recovery of a single speech source in noisy, reverberant environments; such applications include hands-free telephony in automobiles, teleconferencing, voice over IP (VoIP) in front of a computer, surveillance, and speech communication in noisy industrial environments such as factories, cockpits, and magnetic-resonance-imaging (MRI) machines—to name a few. See Atkinson, T. Claiborne, M. P. Flannery, and K. R. Thulborn, *A noise cancellation scheme for fMRI involving participant speech*, Proceedings of Int'l. Soc'y for Magnetic Resonance in Med., Abstract No. 5304 (2006). Each of these applications presents unique challenges.

The automobile environment is characterized by diffuse, non-stationary background noise, such as tire and wind noise. This noise is not easily modeled as a mixture of discrete noise sources, and discrete-noise-source models typically require many more noise sources than sensors. The impulse response of the automobile environment is characterized by early reflections with rapid decay in amplitude; and therefore short reverberation time. The movement of the speaker is usually minimal Furthermore, severe constraints can exist for hands-free microphone placement, such as on the vehicle dashboard or moveable visor.

In contrast, teleconferencing, which usually takes place in an office environment, is characterized by impulse responses containing strong, late reflections with slow decay in amplitude, and therefore long reverberation time. Many speakers can be present, each moving minimally, at widely varying distances, and typically speaking one at time. Background noise comes from sources such as computers, air vents, and other machine noise. VoIP environments, in home or office environments, are characterized by similar impulse-response and noise characteristics.

Speech communication environments in noisy industrial settings, such as in factories, cockpits, and MRI machines, vary widely in reverberation time, microphone placement, speaker position, and noise characteristics. Typically the noise is heavy, somewhat non-stationary, and may require application-specific preprocessing of the microphone signals. In surveillance applications, further challenges exist, given that the subject may potentially face away from some or all of the microphones.

Typically, a speech recovery technique for these environments would be robust to microphone type, room response, convolutional mixing, non-stationary, diffuse and/or localized noise sources of varying intensities, and widely varying speaker location and microphone placement. Existing speech-recovery techniques may nominally address some of these challenges, but they usually have built-in assumptions that are incompatible with the real-world implementation. These limiting assumptions tend to fall into two categories: knowledge of the auditory scene (usually is not available), and unrealistic restrictions regarding source and interference characteristics.

A practical frequency-domain technique for blindly recovering single, nonstationary, high-kurtosis speech source in arbitrary low-kurtosis interference using narrowband kurtosis objective is presented. In one form, this technique handles convolutional mixing, does not impose a theoretical limit on the number of interferers, and uniquely leverages the kurtosis properties of the desired speech source and typical interference. A further form makes use of noise output estimates to determine a linear postfilter. Signal-to-interference ratio (SIR) gains of 5 to 15 dB using only 2-3 microphones have been demonstrated at low input SIRs in real-world situations.

Many sources of real-world background noise fit a low-kurtosis model, while speech tends to be a high-kurtosis signal. Instantaneous-mixing blind source separation can take advantage of this observation by using a maximum-kurtosis objective. This observation can also be adapted to linear combinations of speech signal with lower-kurtosis noise signals, which tend to have lower kurtosis than that of the speech signal alone. For the convolutional-mixing case, maximum-kurtosis is extended to the frequency domain, with short-time spectra that largely preserve the speech envelope.

With moderate-to-high SIR under certain conditions, it has been shown that the maximum-kurtosis criterion results in filter weights that are close (within unit-magnitude complex scale factor) to the normalized Wiener beamformer.

While this approach fits these applications and effectively recovers a speech source from noise in each frequency bin, the complex-scale-factor ambiguity inherent in frequency-domain BSS is present in the MKDR technique. This ambiguity is resolved by recovering the speech as it would appear at a selected microphone without interference by using an MVDR beamformer with steering vector estimated from the weights that maximize kurtosis. Recovering speech in the frequency domain by treating each bin independently results in circularity effects that can be mitigated by windowing.

In one embodiment of the present application, the MKDR algorithm provides a practical frequency-domain technique for blindly recovering a single, nonstationary, high-kurtosis source in low-kurtosis interference using a narrowband kurtosis objective. This technique does not impose a theoretical limit on the number or type of interferers, is not limited to a specific type of microphone, and does not require sparsity of the source or interferers in many implementations. It generally offers a desirable outcome despite convolutive mixing, intelligently handles scaling ambiguities, leverages kurtosis properties of the source and interference, and provides real-data results similar to (non-blind) frequency-domain MVDR beamforming. In some cases the MKWE extension provides real-data results similar to (non-blind) frequency-domain Wiener beamforming.

In a further embodiment, a maximum-kurtosis, distortionless response (MKDR) technique and an optional extension, the maximum-kurtosis, Wiener estimate (MKWE) technique, are provided. In one form, blind estimates of the speech source's channel response are made from the microphone data and MVDR is applied. The source direction is estimated by finding weights that maximize output kurtosis, or the fourth central statistical moment, in the frequency domain. The MKWE approach approximates the Wiener filter by using MKDR-output noise power estimates to compute a Wiener postfilter. These approaches can be extended to block-adaptive versions if the speech source is not quickly moving in space.

A summary of one blind recovery, kurtosis-based signal processing technique according to the present application is as follows:

A. Find kurtosis-maximizing, instantaneous-mixing weights in each frequency-domain bin:

- weights normalized due to scaling ambiguity in each bin;
- kurtosis constraint is applied;
- in moderate-to-low interference, weights are scaled versions of wiener; and
- minimum variance, distortionless response (MVDR) filters;

B. Scale such that selected-sensor weights are 1 across frequency:

- bypasses bin scaling ambiguities;
- result is steering vector (SV) estimate;

C. Compute MVDR weights using SV estimate; and

- recovers source as appears at selected sensor.

D. Window half, zero half of spatio-temporal filter to mitigate circularity effects, excess time smearing.

Figure 12:
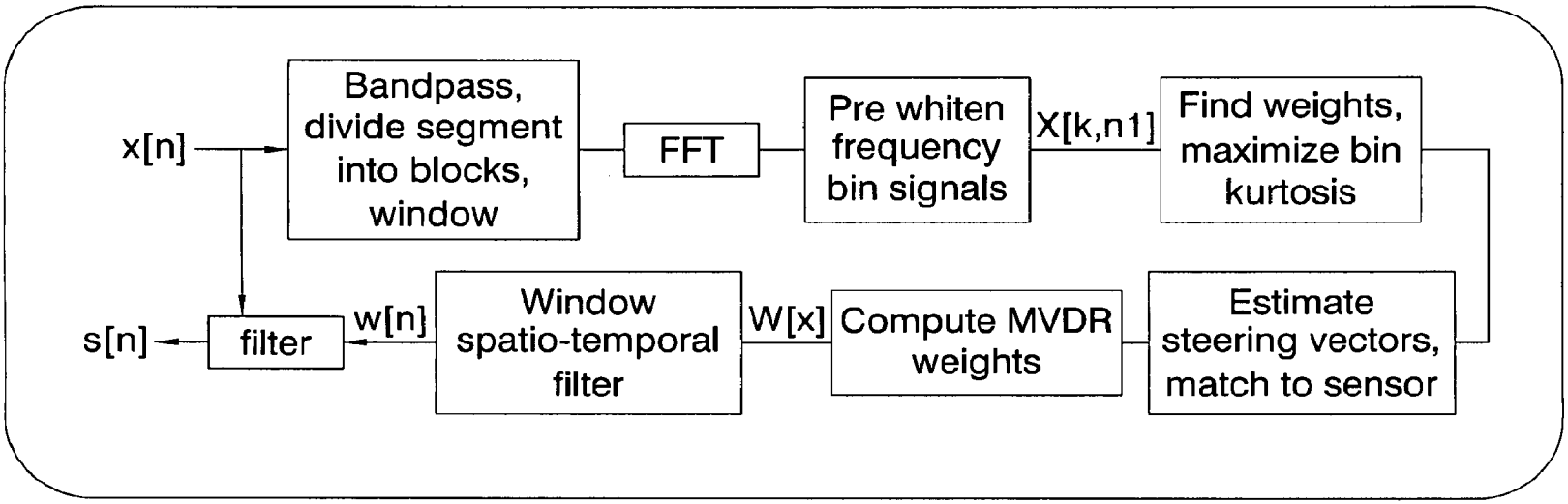
FIG. 12. is a further diagrammatic view of a kurtosis-based speech recovery technique.
Figure 13:
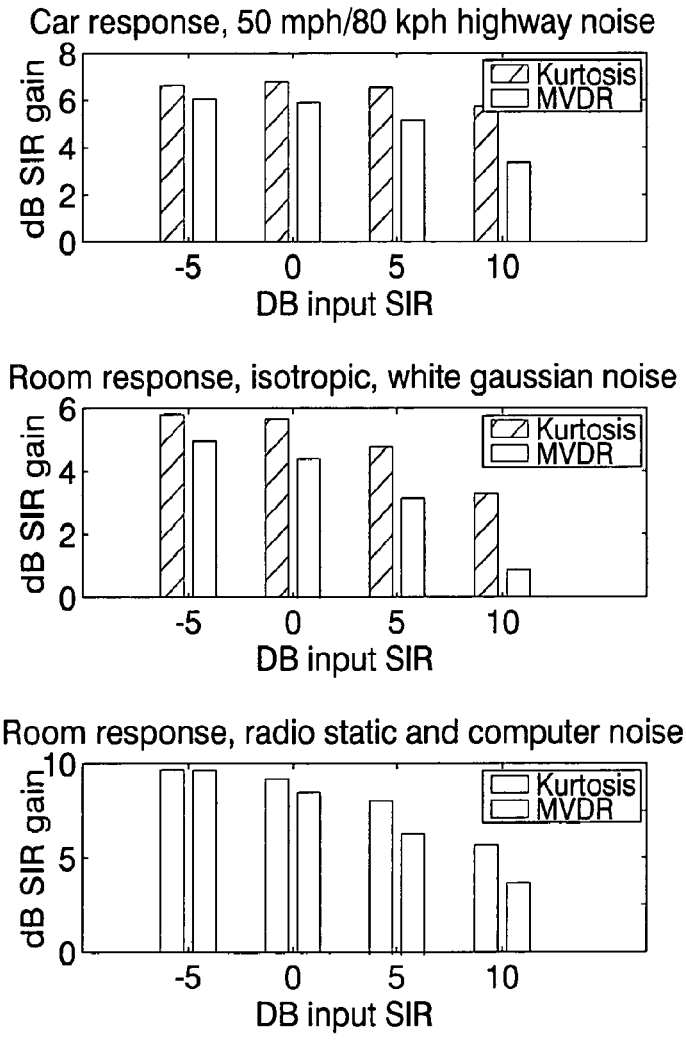
FIG. 13. depicts various experimental results.
Figure 13:
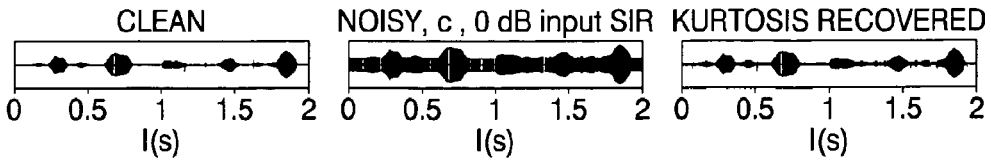

This processing summary of one nonlimiting embodiment is further depicted in the control flow block diagram of FIG. 12.

FIG. 1. is a diagrammatic illustration of a system 100 for blind signal recovery according to another embodiment of the present application. The system 100 includes a sound input comprising a source 102 and sound interferers 104A, 104B, 104C, 104D. These sound interferers 104A, 104B, 104C, 104D may be noise, babble, or another type of interference as would occur to those skilled in the art. The system 100 further includes sound sensor devices 106A, 106B structured to receive the sound input and to convert the sound input into a computer-readable sound signal. The sound sensors 106A, 106B include any sound detection mechanism understood in the art, and may include multiple microphones arrayed for each sensor device 106A, 106B.

The computer readable signal may be in the form of an electronic signal, a datalink communication, and/or an optical signal. The system 100 includes a processing subsystem 108 including a controller 108*a* and memory 109. Controller 108*a* receives various inputs and generates various outputs to perform various operations as described hereinafter in accordance with its operating logic. Controller 108*a* can be an electronic circuit comprised of one or more components, including digital circuitry, analog circuitry, or both. Controller 108*a* may be a software and/or firmware programmable type; a hardwired, dedicated state machine; or a combination of these. In one embodiment, controller 108*a* is a programmable microcontroller solid-state integrated circuit that integrally includes one or more processing units and memory 109. Memory 109 can be comprised of one or more components and can be of any volatile or nonvolatile type, including the solid state variety, the optical media variety, the magnetic variety, a combination of these, or such different arrangement as would occur to those skilled in the art. Further, when multiple processing units are present, controller 108*a* can be arranged to distribute processing among such units, and/or to provide for parallel or pipelined processing if desired. Controller 108*a* functions in accordance with operating logic defined by programming, hardware, or a combination of these. In one form, memory 109 stores programming instructions executed by a processing unit of controller 108*a* to embody at least a portion of this operating logic. Alternatively or additionally, memory 109 stores data that is manipulated by the operating logic of controller 108*a*. Controller 108*a* can include signal conditioners, signal format converters (such as analog-to-digital and digital-to-analog converters), limiters, clamps, filters, and the like as needed to perform various control and regulation operations described in the present application.

Controller 108*a* is structured to interpret the computer-readable sound signal and to divide the computer readable sound signal for processing in accordance with the MKDR technique, optimally the MKWE extension, and/or variations thereof based on operating logic executed by controller 108*a* as further described hereinafter. For instance, based on this operating logic, controller 108*a* is effective to divide the computer readable sound signal into a plurality of different frequency bins in a frequency domain format using standard techniques. A recovery-filter weight set is determined for each frequency bin based on a kurtosis property. In certain embodiments, the controller 108*a* is further structured to determine a plurality of steering vectors, each steering vector corresponding to one of the frequency bins and one of the sound sensors, and to determine a plurality of beamformers according to the steering vectors and the recovery-filter weight sets, each beamformer corresponding to one of the frequency bins. The controller may be structured to apply a tapered window to each of the beamformers, and to determine a primary signal as a function of the computer readable sound signal and the windowed beamformers.

The system further includes an output device 110 structured to provide a primary output signal 112. The output device may include a memory storage device, an electro-magnetic transmitter, a computer network communication device, loudspeaker, headphones and/or another type of acoustic transmitter—just to name a few examples. The primary signal 112 may be a broadcast signal representative of the source 102 (for example, speech), a signal storage device (for example—storage of a data voice recording on an optical, semiconductor, and/or magnetic medium), an electronic current and/or voltage variation on an electrical line, and/or a loudspeaker signal.

The source 102 may be a human voice (speech), and/or another type of sound or other acoustic waveform that exhibits a higher kurtosis value than at least one of the interferer. The kurtosis of the signal is the degree of non-Gaussian nature of the signal, or the sharpness of the signal "peak"—its "peakedness." In many ordinary environments, background noises exhibit low kurtosis while a human voice exhibits a relatively high kurtosis.

Figure 2:
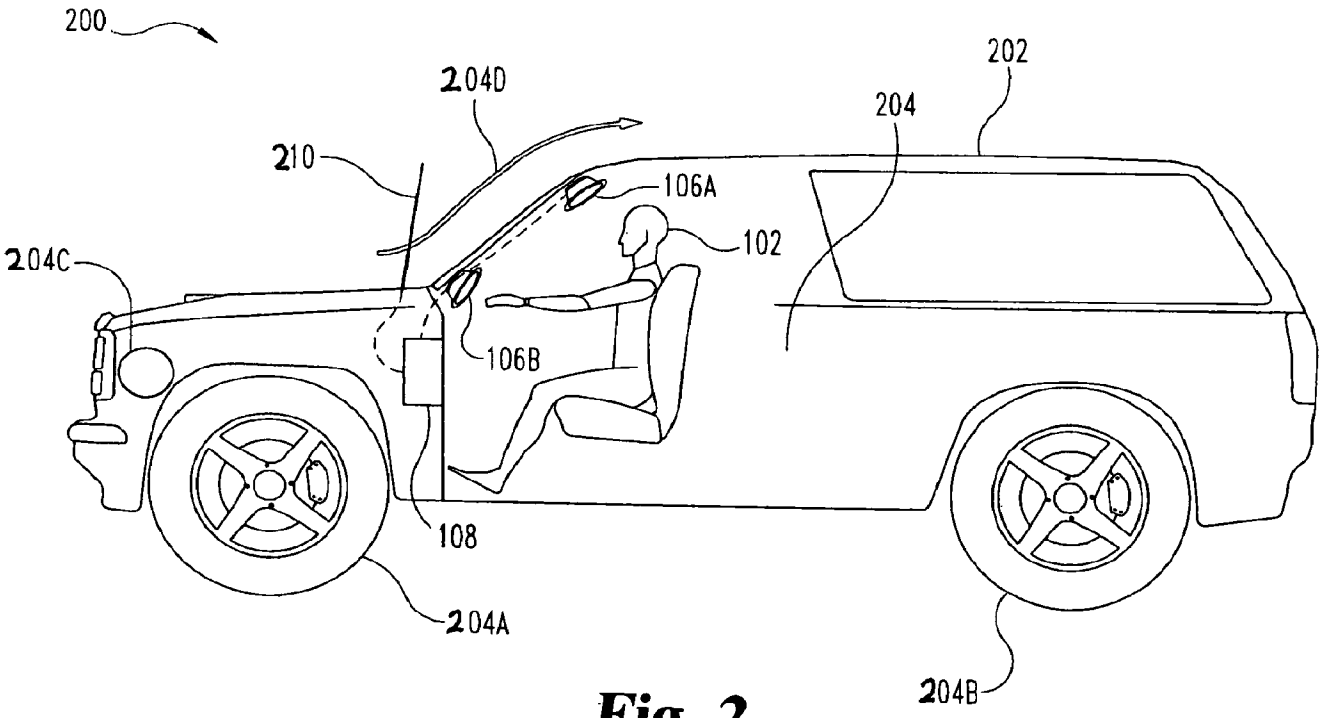
FIG. 2. is a diagrammatic illustration of a system including a mobile vehicle.

Referring to the alternative embodiment of FIG. 2, system 200 includes a mobile vehicle 202; where like reference numerals refer to like features. The source 102 includes sound (such as speech) from a human within the mobile vehicle 202, and wherein the sensor device 106B includes a microphone acoustically coupled to a passenger compartment 204 of the vehicle 202. System 200 includes processing subsystem 108 that operates in accordance with its operating logic to separate speech from background noise as represented by wind 204D, tire/road noise 204A, 204B; and engine noise 204C. A corresponding output signal may be transmitted with antenna 210.

Figure 3:
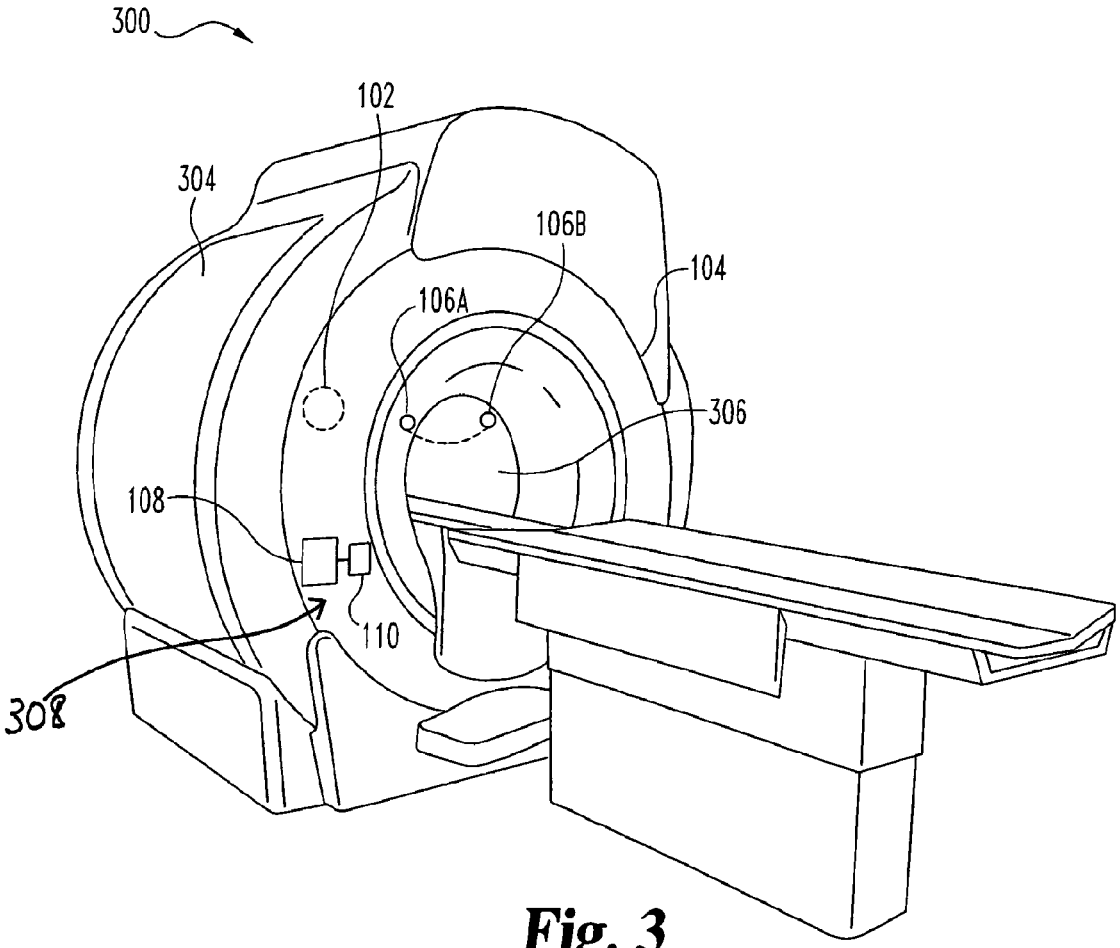
FIG. 3. is a diagrammatic illustration of a system including an MRI machine.

Referring to the further embodiment of FIG. 3, system 300 includes a hands-free communication subsystem including sound sensor devices 106A, 106B, the processing subsystem 108, and the output device 110; where like reference numerals refer to like features. System 300 includes a magnetic image resonance (MRI) machine 304, and a patient communication subsystem 308 structured for use with a patient 306 positioned at least partially in the MRI machine 304, where the patient communication subsystem 308 includes the sound sensor devices 106A, 106B, the processing subsystem 108, and the output device 110. In accordance with the kurtosis-based, blind-recovery techniques of the present application, subsystem 308 is structured to separate speech from a patient in machine 304 from MRI-machine noise as designated by reference numeral 104.

Figure 4:
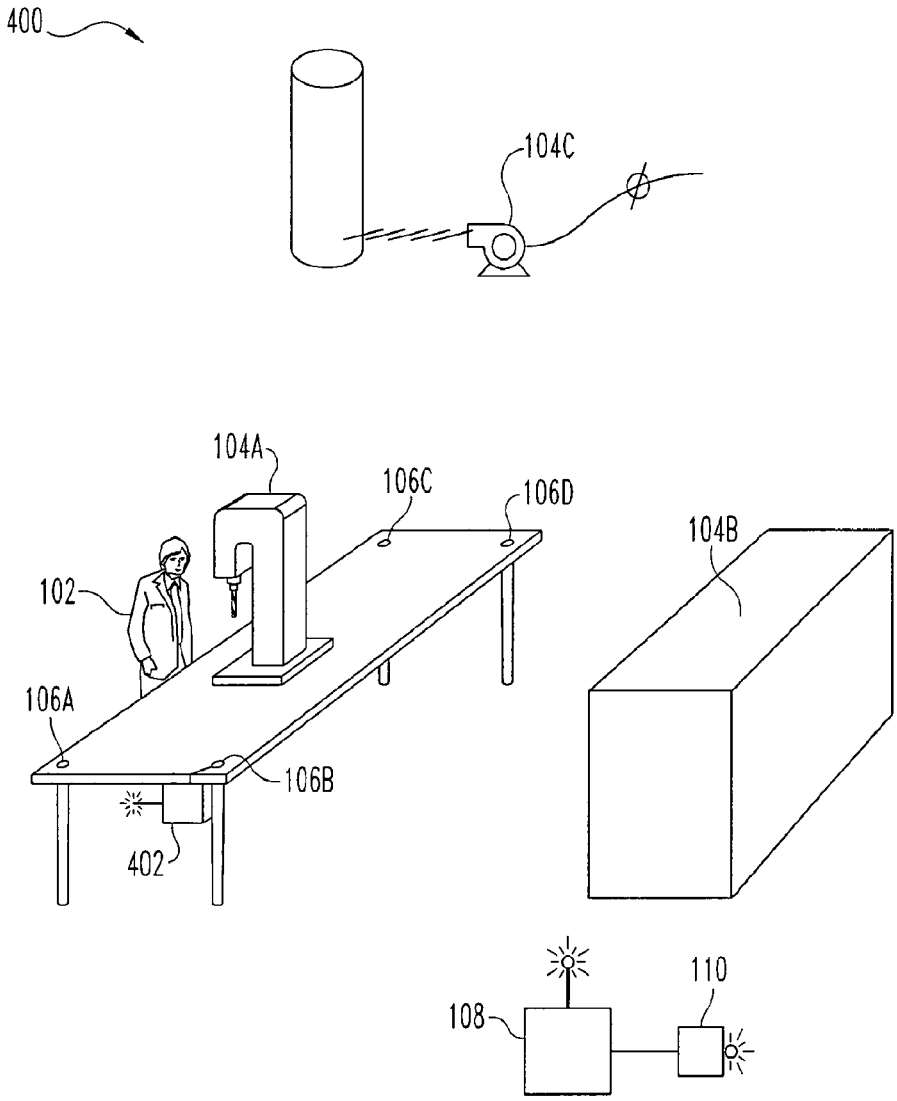
FIG. 4. is a diagrammatic illustration of a system including a noisy shop environment.

Referring to FIG. 4, system 400 includes a noisy environment of a typical machine shop, a sound source 102, a plurality of noise sources 104A, 104B, 104C, and a plurality of sound sensor devices 106A, 106B, 106C, 106D; where like reference numerals refer to like features. In certain embodiments the processing subsystem 108 is distributed away from the sound source 102, for example through wireless communication with a broadcasting device 402. In the example illustrated in FIG. 4, the output device 110 may be an intercom in an office where the sound source 102 is on the shop floor. System 400 is structured to distinguish source 102 from the interference posed by noise sources 104A, 104B, 104C in accordance with the kurtosis-based, blind recovery techniques described herein.

Next, further details of the kurtosis-based, blind recovery techniques are described. It should be appreciated that systems 100, 200, 300, 400 and other applications of interest have a high-kurtosis speech source compared to lower-kurtosis background noise, which may be modeled as a high-kurtosis source s(n) convolutively mixed with lower-kurtosis interference $N_r(n)$, $r=\{1, \ldots, R\}$, recorded at R microphones as shown in expression (1) as follows:

$$x_r(n) = \sum_{p=0}^{P-1} h_r(p)s(n-p) + N_r(n) \tag{1}$$

The speech is recovered by finding R Q-tap filters $w_r$ that recover the speech as it sounds at a particular sensor is represented in expression (2) as:

$$y(n)_j = \sum_{r=1}^{R_j} \sum_{q=0)}^{Q-1} w_r(q)x_r(n-q) \tag{2}$$

Where: y is the recovered signal, and j is the selected sensor. Signals equal to the speech as it appears at each microphone, $t_r(n)$, with no interferers present are defined with expression (3) as follows:

$$t_r(n) = \sum_{p=0}^{P-1} h_r(p)s(n-p) \tag{3}$$

Similarly, the processed target signal $y_t(n)$ is defined in expression (4) as:

$$y_t(n) = \sum_{r=1}^{R} \sum_{q=0)}^{Q-1} w_r(q)t_r(n-q) \tag{4}$$

and the processed noise signal $y_N(n)$ is defined in equation (5) as:

$$y_N(n) = \sum_{r=1}^{R} \sum_{q=0}^{Q-1} w_r(q)N_r(n) \tag{5}$$

Because the source mixing is convolutional, the recovery filters in the frequency domain are defined with expression (6) as:

$$Y_k[m]=(W_k^H X_k[m])^t \tag{6}$$

Where: m $\{0, \ldots, M-1\}$ is the segment or frame index, $k=\{0, \ldots, K-1\}$ is the frequency bin index, and $X_k[m]=[X_{1,k}[m], \ldots, X_{R,k}[m]]^t$. Similarly, the signals $Y_{t,k}[m]$ and $Y_{N,k}[m]$ are defined to be the frequency-domain, target- and noise-only filtered outputs, respectively. For real signals it is sufficient to find recovery filters over $k=\{0, ., K/2\}$. As used herein, an H superscript ($^H$) is used to indicate a Hermitian transpose of a variable (matrix).

The assumption of high-kurtosis speech source in low-kurtosis noise is expressed in each frequency bin by expressions (7)-(9).

$$K(S_k[m])>0 \tag{7}$$

$$K(S_k[m])>K(N_{r,k}[m]) \text{ for all } r \tag{8}$$

Where:

$$K(S_k[m]):=E_m[|S_k[m]|^4]-2E_m^2[|S_k[m]|^2]-|E_m[S_k^2[m]]| \tag{9}$$

and $E_m$ is the expectation operator with respect to m. Because the source is identified from the interference, expression (10) applies a condition as follows:

$$E_m[S_k[m]N_{r,k}[m]]=0 \text{ for all r} \tag{10}$$

and a further condition is that the speech source is not moving too quickly spatially. It is also assumed the second and fourth central moments of the interference are approximately static over the current block used to estimate recovery filters—a sufficient condition for constant central moments is stationarity of the interference.

The time interval over which the filters are computed should be long enough to accurately estimate the correlation matrices in each bin, such that $\hat{R}_{x_k x_k} \approx R_{x_k x_k}$, whereas defined in expressions (11) and (12):

$$R_{x_k x_k} = E_m[X_k[m]X_k^H[m]] \tag{11}$$

$$\hat{R}_{x_k x_k} = \frac{1}{M}\sum_{m=0}^{M-1} X_k[m]X_k^H[m] \tag{12}$$

An adaptive version of this filter can be constructed if the environment is changing in a sufficiently slow manner such that $w_r(n)$ can be updated by computing them over new segments of $X_k[m]$.

The maximum-kurtosis, distortionless response (MKDR) technique has four components: (a) find normalized recovery-filter weights in each frequency bin, (b) estimate steering vectors from the recovery weights, (c) construct MVDR beamformers in each bin using the estimated steering vectors, and (d) window the MVDR filters to get the final recovery filters. The maximum-kurtosis, Wiener-estimate (MKWE) extension has an extra post-filtering operation before windowing.

Find normalized recovery-filter weights: The recovery-filter weights are found in each bin by taking advantage of the assumptions and finding weights $U_k$ that maximize the kurtosis of the output per expression (13) as follows:

$$U_k = \underset{U_k}{\operatorname{argmax}} Em[|U_k X_k[m]|^4] \text{ s.t. } \|U_k\|_2^2 = 1 \tag{13}$$

$X_k$ [m] is first numerically preconditioned so that it is both spectrally and spatially white in accordance with expression (14) as follows:

$$\hat{R}_{x_k x_k}=I \tag{14}$$

where I is the identity matrix. This prewhitening is done by passing $X_k[m]$ through mixing matrix $M_k=\Sigma^{-1/2}V$ where $V\Sigma V^H$ is the eigendecomposition of $\hat{R}_{x_k x_k}$. The filter weights $U_k$ are then transformed back using the inverse transformation $M_k^{-1}$.

Because the objective is not convex, a gradient-descent technique with multiple starting points can be employed. The set of starting points with elements all-zero except for a single 1 (one) has been found to be sufficient for good results with speech.

Estimate steering vectors for MVDR beamformer: With moderate-to-high SIR and certain assumptions, including uncorrelated source and interference, it has been found that expression (13) results in filter weights that are close (within unit-magnitude complex scale factor) to the normalized Wiener (optimal linear) beamformer as reflected by expression (15):

$$U_k \approx U_{k,Wiener} := \alpha_k R_{X_k X_k}^{-1} E_m[X_k[m]S_k^*[m]] \tag{15}$$

where $\alpha_k$ is a complex scale factor such that $\|U_{k,Wiener}\|_2^2=1$, and the remainder of expression (15) is the standard definition of the Wiener beamformer. Under the condition that the speech and interference are uncorrelated, expression (16) applies as follows:

$$E_m[X_k[m]S_k^*[m]]=E_m[T_k[m]S_k^*[m]]:=e_k \tag{16}$$

where $T_k[m]$ is the frequency-domain representation of t(n) and $e_k$ is the steering vector. In this uncorrelated case, the normalized Wiener filter is identical within a unit-magnitude, complex scale factor to the normalized MVDR beamformer. Therefore, under the same conditions, the kurtosis approach also results in filter weights that are close to the normalized MVDR beamformer as reflected by expression (17):

$$U_k \approx U_{k,MVDR} := \gamma_k \frac{R_{X_k X_k}^{-1} e_k}{e_k^H R_{X_k X_k}^{-1} e_k} \tag{17}$$

where $\gamma_k=\alpha_k(e_k^H R_{X_k X_k}^{-1} e_k)^{-1}$ is a complex scale factor such that $\|U_{k,MVDR}\|_2^2=1$ and the ratio in expression (17) is the standard definition of the MVDR beamformer.

The constraint in expression (13) exists because scaling ambiguity ($\alpha_k$ or $\gamma_k$) is implicit in the weights.

A common approach in resolving the bin-by-bin scale ambiguities $\{\alpha_k\}$ is to recover the sources as they appear at a particular sensor. For the Wiener filter this is accomplished through the relationship of expression (18) as follows:

$$V_{k,Wiener} = \hat{R}_{x_k x_k}^{-1} \frac{1}{M}\sum_{m=0}^{M-1} X_k[m][T_k^*[m]]_j \tag{18}$$

Where the operator $[\cdot]j$ is the jth element of a vector defined in the square brackets [ ] ($T_k^*[m]$ in expression (18)). Even with the uncorrelated assumption, the power in $T_k^*[m]_j$ is needed to unambiguously determine the Wiener filter. Expression (17); however, can be applied to compute an MVDR beamformer. First a steering vector, referenced to a selected channel, j, is estimated according to expression (19) as follows:

$$\hat{e}_{k,j} = \frac{\hat{R}_{X_k X_k} U_k}{[\hat{R}_{X_k} U_k]_j} \approx e_{k,j} := \frac{E_m[X_k[m][T_k^*[m]]_j]}{[E_m[X_k[m][T_k^*[m]]_j]]_j} \tag{19}$$

where $\alpha_k$ cancels in the first fraction. This steering vector estimate causes the MVDR beamformer to recover the source as it would be heard (i.e., distortionless) at the $j^{th}$ sensor; where j can be fixed or it can be set to the channel having the largest (weighted) number of largest normalized weight magnitudes per expression (20):

$$j = \frac{\operatorname{argmax}}{l}\sum_k \delta_k I(|U_{k,l}| > |U_{k,i}| \text{ for all } i) \tag{20}$$

where $I(\cdot)$ is the indicator function, and $\{\delta_k\}$ are weights. The steering vector estimate accuracy increases as $U_k$ approaches optimal and the uncorrelated assumption is accurate.

Construct MVDR beamformers: the MVDR beamformer $V_k$ is computed from $\hat{e}_{k,j}$ per expression (21):

$$V_k = V_{k,MVDR} = \frac{\hat{R}_{x_k x_k}^{-1} \hat{e}_{k,j}}{\hat{e}_{k,j}^H \hat{R}_{X_k X_k}^{-1} \hat{e}_{k,j}} \tag{21}$$

Window MVDR filters: The R inverse filters specified by the beamformers $\{V_k\}$ contain circularity artifacts and may not be directly suitable for linear deconvolution. Factors affecting their suitability include the equivalence of multiplication in the discrete-Fourier-transform domain to circular convolution, general finite-impulse-response inverse filters requiring an infinite number of taps, and signal segmentation into small frames leaving significant parts of the mixing convolution in the following frame(s). Therefore, the impulse responses of $V_k$ are generally spread out in time, which leads to excess time-smearing of the signals. These inverse-filter circularity problems can be reduced via spectrally smoothing $V_k$ into $W_k$, which is accomplished by windowing the filters with tapered window followed by zeros per expression (22) as follows:

$$[W_k]_i = \sum_{n=0}^{K-1} \beta(n) v_i(n) e^{-j\frac{2\pi kn}{K}} \tag{22}$$

$$\text{Where } v_i(n) = \sum_{k=0}^{K-1} [V_k]_i e^{j\frac{2\pi kn}{K}} \text{ and}$$

$$\beta(n) = \begin{cases} 0.538 - 0.462\cos\left(\frac{2\pi n}{Q-1}\right) & n = 0, \ldots, Q-1 \\ 0 & n = Q, \ldots, K-1 \end{cases}$$

The filters specified by $W_k$ are the MKDR filters that are applied to the noisy input signal. Windowing does introduce some deviation in the relative weights in each $V_k$, but interference suppression can be gained with increased target distortion.

MKWE extension: the optimal Wiener filter in each frequency bin, applied as a postfilter, can be estimated given an estimate of the noise. This is done by applying a scale factor $\lambda(k)$ to each $V_k$ before windowing per expressions (23)-(25):

$$\lambda(k) = \frac{\hat{\sigma}^2_{Y_{L,k}}}{\sigma^2_y} = 1 - \frac{\hat{\sigma}^2_{Y_{N,k}}}{\sigma^2_y} \tag{23}$$

$$v'_i(n) = \sum_{k=0}^{K-1} \lambda(k)[V_k]_i e^{j\frac{2\pi kn}{K}} \tag{24}$$

$$[W'_k]_i = \sum_{n=0}^{K-1} \beta(n) v'_i(n) e^{-j\frac{2\pi kn}{K}} \tag{25}$$

where $\sigma_y^2$ refers to the power of signal y. The filters specified by $W_k'$ are the MKWE filters that are applied to the noisy input signal.

Various methods exist to estimate noise power in a speech signal. One approach that was used to estimate noise power is as follows. First, find fixed percentage of the lowest-power frames (lowest fixed percentile) in each bin, then average these powers into a power estimate for each frequency bin. These power estimates have a downward bias, so a scale factor must be applied to remove the bias. If the bin-by-bin distributions on the noise power is known or assumed, the bias-removing scale factors can be computed analytically. If the distribution are not known, the scale factors can be computed empirically from a nearby noise-only portion of the signal by taking the ratio of the noise power to the lowest-fixed-percentile power.

Figure 5:
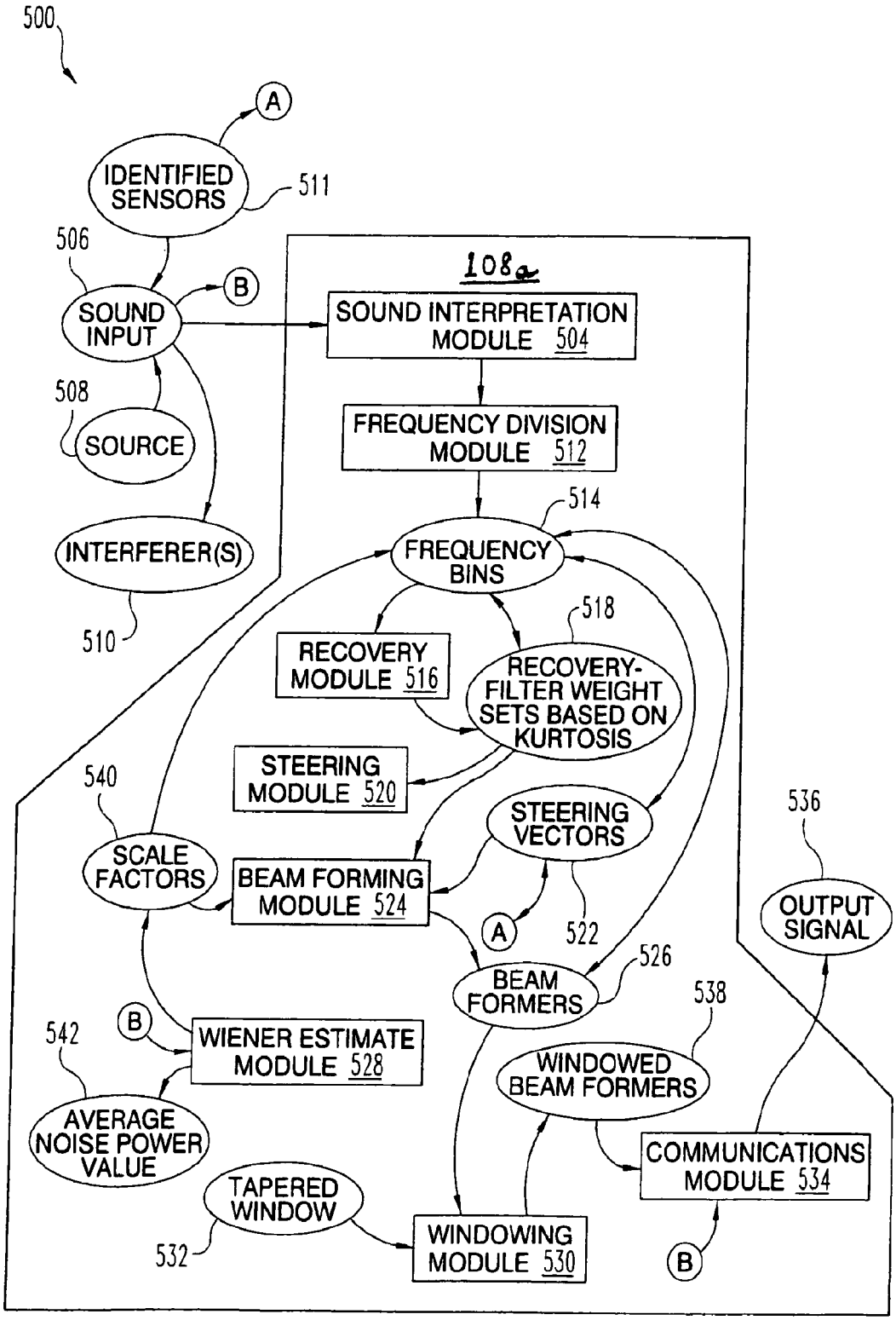
FIG. 5. is a diagrammatic illustration of a controller structured to functionally execute operations for blind signal recovery.

FIG. 5. is a further illustration of controller 108*a* with operating logic characterized in module form to functionally execute operations for blind signal recovery according to various embodiments of the present invention. The controller 108*a* may comprise at least a portion of a processing subsystem 108. Controller 108*a* includes a sound interpretation module 504 structured to interpret a sound input 506 that comprises a source 508 and at least one interferer 510. The sound input 506 is collectively the sound—representative signals generated with sensors 511. Interpreting the sound input 506 includes any method of interpreting sound input, including without limitation at least reading an electronic signal, reading a datalink communication value, reading a memory value, and receiving a fiber optic communication.

Controller 108*a* further includes a frequency domain conversion module 512 structured to convert the sound input from the time domain into a plurality of frequency bins 514—typically using a discrete transform technique. Also included is recovery module 516 structured to determine a plurality of recovery-filter weight sets 518, each corresponding to one of the different frequency bins 514. Controller 108*a* further includes a steering module 520 structured to determine a plurality of steering vectors 522, that each correspond to one of the frequency bins 514 and one of the identified sound input sensors 511. Controller also includes a beamforming module 524 structured to determine a plurality of beamformers 526 as a function of the steering vectors 522 and the recovery-filter weight sets 518, with each beamformer 526 corresponding to one of the frequency bins 514. Controller 108*a* further includes a windowing module 530 structured to apply a tapered window 532 to each of the beamformers 526, and a communications module 534 structured to provide an output signal 536 as a function of the sound input 506 and the windowed beamformers 538. Output signal 536 is representative of the sound or acoustic signal emanating from source 508.

Controller 108*a* also includes an optional Wiener estimate module 528 structured to determine a plurality of scale factors 540, each scale factor corresponding to one of the frequency bins 514. For this option, the beamforming module 524 is structured to apply one of the scale factors 540 to each of the beamformers 526. In one nonlimiting implementation, the Wiener estimate module 528 is further structured to determine an average noise power value 542, and to determine the plurality of scale factors 540 as a function of the average noise power value 542.

Figure 6:
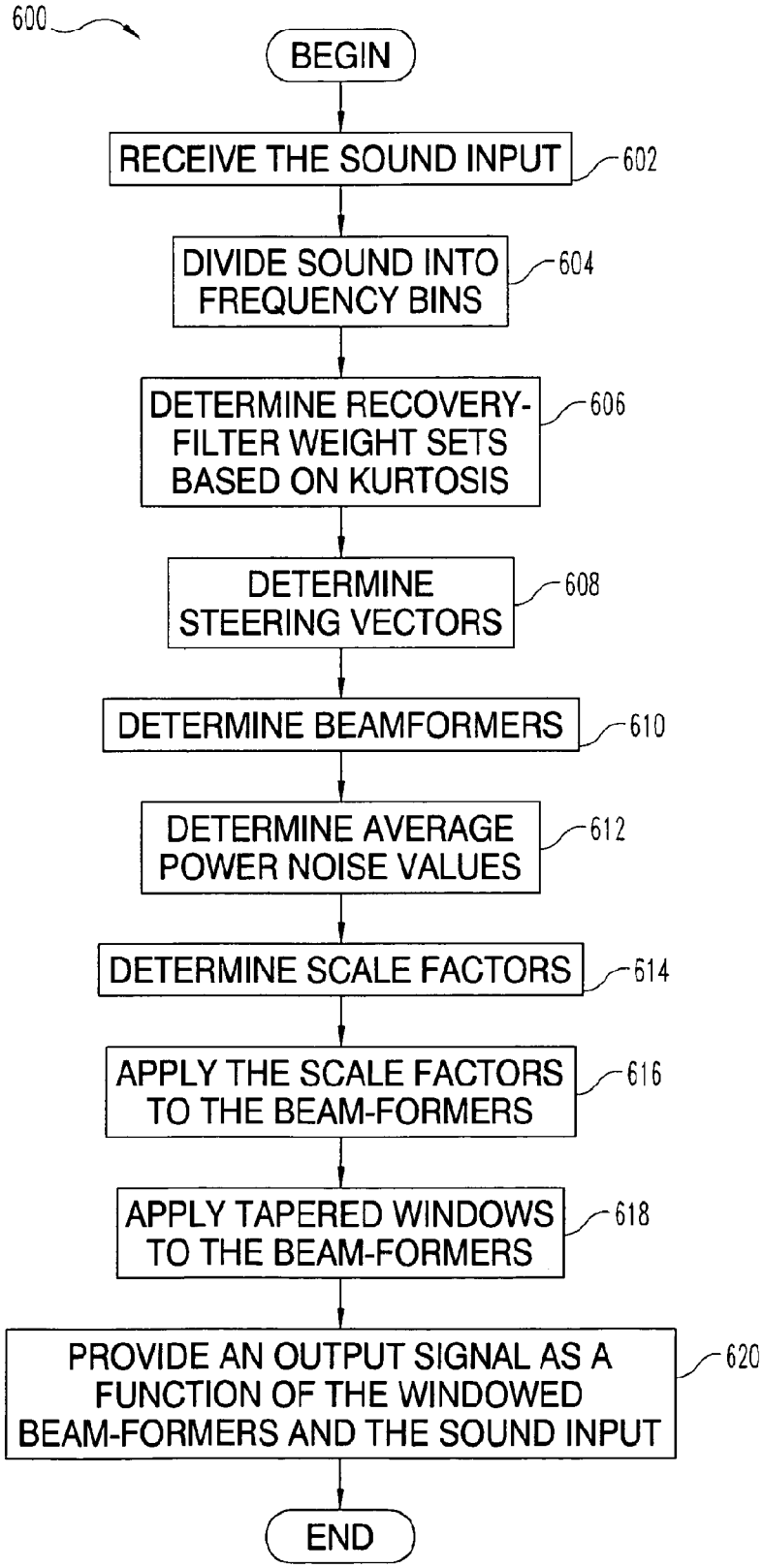
FIG. 6. is a flow chart illustrating a procedure for blind signal recovery.

FIG. 6. is a schematic flow chart diagram illustrating a procedure 600 for blind signal recovery that may be implemented with system 100, 200, 300, and/or 400 in accordance with operating logic of controller 108*a*. Procedure 600 includes operation 602 that receives a sound input from a plurality of sound input sensors. The sound input comprises a source and at least one sound interferer. Procedure 600 continues with operation 604 which transforms the sound input from the time domain to the frequency domain to be represented relative to plurality of frequency bins. The procedure 600 further includes operation 606 to determine a plurality of recovery-filter weight sets. Each recovery-filter weight set corresponds to one of the frequency bins. Operation 608 determines a plurality of steering vectors, that each steering vector correspond to one of the frequency bins and one of the sound input sensors. Operation 610 determines a plurality of beamformers according to the steering vectors and the recovery-filter weight sets. Each beamformer corresponds to one of the frequency bins. Procedure 600 further includes operation 612 to determine average power noise values, and operation 614 to determine a plurality of scale factors as a function of the average power noise values. Operation 616 of procedure 600 applies the scale factors to the beamformers. Operation 618 applies a tapered window to each of the beamformers, and operation 620 provides an output signal as a function of the sound input and the windowed beamformers.

As is evident from the figures and text presented above, a variety of embodiments of the present application are contemplated. For example, one embodiment comprises: receiving a sound input including a combination of speech and sound interfering with the speech with a plurality to spaced-apart sound sensors; determining a plurality of recovery-filter weights by modeling the speech with greater kurtosis than the sound interfering with the speech; determining a plurality of steering vectors for the sound input sensors; providing a plurality of beamformers according to the steering vectors and the recovery-filter weights; and providing an output signal representative of the speech with the beamformers.

Another embodiment comprises: receiving a sound input including a combination of speech and sound interfering with the speech with a plurality to spaced-apart sound sensors; processing the sound input to separate the speech from the sound interfering with the speech based on a degree of kurtosis of the speech greater than the sound interfering with the speech; and establishing a plurality of beamfoimers with the processing to generate an output signal representative of the speech.

Still another embodiment is directed to an apparatus, comprising a processing subsystem that includes: means for receiving a sound input including a combination of speech and sound interfering with the speech with a plurality to spaced-apart sound sensors; means for determining a plurality of recovery-filter weights by modeling the speech with greater kurtosis than the sound interfering with the speech; means for determining a plurality of steering vectors for the sound input sensors; means for providing a plurality of beamformers according to the steering vectors and the recovery-filter weights; and means for providing an output signal representative of the speech with the beamformers.

Yet another embodiment is directed to an apparatus, comprising a processor subsystem structured with means for receiving a sound input including a combination of speech and sound interfering with the speech; and means for processing the sound input to separate the speech from the sound interfering with the speech based on a degree of kurtosis of the speech greater than the sound interfering with the speech, the processing means including means for providing a plurality of beamformers to generate an output signal representative of the speech.

Another exemplary embodiment includes an apparatus with a processing subsystem. In certain embodiments, the processing subsystem includes a sound interpretation module structured to interpret a sound input, the sound input comprising a source and at least one interferer, wherein the sound input is divided into a plurality of portions, each portion corresponding to an identified sound input sensor. In other embodiments, the processing subsystem further includes a frequency division module structured to divide the sound input into a plurality of frequency bins, and a recovery module structured to determine a plurality of recovery-filter weight sets, each recovery-filter weight set corresponding to one of the frequency bins. In certain embodiments, the processing subsystem further includes a steering module structured to determine a plurality of steering vectors, each steering vector corresponding to one of the frequency bins and one of the identified sound input sensors, and a beamforming module structured to determine a plurality of beamformers as a function of the steering vectors and the recovery-filter weight sets, each beamformer corresponding to one of the frequency bins. In further embodiments, the processing subsystem further includes a windowing module structured to apply a tapered window to each of the beamformers, and a communications module structured to provide an output signal as a function of the sound input and the windowed beamformers.

In certain further embodiments, the processing subsystem further includes a Wiener estimate module structured to determine a plurality of scale factors, each scale factor corresponding to one of the frequency bins, and wherein the beamforming module is further structured to apply one of the scale factors to each of the beamformers. In certain further embodiments, the Wiener estimate module is further structured to determine an average noise power value, and to determine the plurality of scale factors as a function of the average noise power value.

One exemplary embodiment includes a system having a sound input comprising a source and at least one interferer, and at least one sound sensor structured to receive the sound input and to convert the sound input into a computer readable sound signal. In certain embodiments, the computer readable signal includes an electronic signal, a datalink communication, and/or an optical signal. In other embodiments, the system includes a processing subsystem including a controller, with the controller structured to interpret the computer readable sound signal and to divide the computer readable sound signal into a plurality of frequency bins. In still other embodiments, the controller is further structured to determine a plurality of steering vectors, each steering vector corresponding to one of the frequency bins and one of the sound sensors, and to determine a plurality of beamformers according to the steering vectors and the recovery-filter weight sets, each beamformer corresponding to one of the frequency bins. In further embodiments, the controller is structured to apply a tapered window to each of the beamformers, and to determine a primary signal as a function of the computer readable sound signal and the windowed beamfoimers. In certain exemplary embodiments, the system further includes an output device structured to provide the primary signal. In certain embodiments, the output device includes a memory storage device, an electro-magnetic transmitter, a computer network communication device, and/or an acoustic transmitter.

In certain embodiments, the source is a human voice, and/or the source exhibits a higher kurtosis value than the at least one interferer. In certain further embodiments, the system includes a mobile vehicle, wherein the source includes a sound from a human within the mobile vehicle, and wherein the at least one sound sensor includes a microphone acoustically coupled to a passenger compartment of the mobile vehicle. In certain further embodiments, the system includes a hands-free communication subsystem including the at least one sound sensor, the processing subsystem, and the output device. In certain embodiments, the system includes a magnetic image resonance (MRI) machine, a patient communication subsystem structured for use with a patient positioned at least partially in the MRI machine, where the patient communication subsystem includes the sound sensor(s), the processing subsystem, and the output device.

Another embodiment includes a method having operations including receiving a sound input on a plurality of sound input sensors, the sound input comprising a source and at least one interferer, dividing the sound input into a plurality of frequency bins, and determining a plurality of recovery-filter weight sets, each recovery-filter weight set corresponding to one of the frequency bins. The method further includes operations of determining a plurality of steering vectors, each steering vector corresponding to one of the frequency bins and one of the sound input sensors, detennining a plurality of beamformers according to the steering vectors and the recovery-filter weight sets, each beamformer corresponding to one of the frequency bins, and applying a tapered window to each of the beamformers. In certain embodiments, the method further includes providing an output signal as a function of the sound input and the windowed beamformers. In other embodiments, the method further includes operations of determining a plurality of scale factors, each scale factor corresponding to one of the frequency bins, and applying one of the scale factors to each of the beam formers. In certain further embodiments, determining the plurality of scale factors further includes determining an average noise power value, which may be determined analytically or empirically.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. All patents, patent application, and publications cited in the present application are hereby incorporated by reference each in its entirety. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

EXPERIMENTAL RESULTS

The following experimental results are provided as merely illustrative examples to enhance understanding of the present invention, and should not be construed to restrict or limit the scope of the present invention.

To evaluate the performance of the technique in several challenging, different, and realistic environments, the maximum-kurtosis technique was tested in a car environment, a reverberant room environment, and in an MRI machine. For the car and reverberant room, a three-sensor, right-triangular array was constructed with three omni-directional microphones spaced 15 cm and 21 cm apart; note, however, the technique does not constrain the microphone positions. Real noise was recorded and impulse responses at the position of a male speaker were measured with a maximum-length pseudo-noise sequence played over an audio speaker. Speech from a male speaker was recorded under quiet conditions. For development purposes, a recording from the TIMIT database of a male speaker played over the loudspeaker was also recorded. These signals were recorded at 32 kHz and downsampled to 8 kHz.

Speech was also recorded in an MRI machine, using a fiber-optic microphone containing two orthogonal, gradient microphones (Optoacoustics FOMRI-II). This microphone was placed close to the patient's mouth. Sentences were recorded at 48 kHz while the machine was in operation. The recorded signals were downsampled to 8 kHz before processing.

The MKDR and MKWE techniques' performances are compared to the non-blind MVDR and Wiener techniques, respectively, because the beamformers in these techniques use information that often is not available in practice. The MVDR technique includes computing the MVDR beamformer in each bin, via expression (21) with $e_{k,j}$, instead of $\hat{e}_{k,j}$, and time-windowing the resulting filters. Similarly, the Wiener technique consists of computing the Wiener beamformer in each bin, via expression (18), and applying the filter window.

The measures used to compare the techniques are the signal-to-interference ratio (SIR) gain, which is a measure of how much speech power passes through the recovery filter versus interference power passed, and a signal-to-distortion ratio (SDR), which compares the power in the distortion of recovery-filtered clean input speech to the power in the reference speech channel. These measures are computed per expressions (26) and (27) as follows:

$$SIR_G = 10\log_{10}\left(\frac{\sum_n y_t^2(n)}{\sum_n (y(n) - y_t(n))^2}\right) - 10\log_{10}\left(\frac{\sum_n t_j^2(n)}{\sum_n (x_j(n) - t_j(n))^2}\right) \tag{26}$$

$$SIR_G = 10\log_{10}\left(\frac{\sum_n t_j^2(n)}{\sum_n (y_t(n) - t_j(n))^2}\right) \tag{27}$$

MVDR beamformers, by definition, maximize $SIR_G$ under the distortionless constraint, which constrains SDR to be infinite. Wiener beamformers, by definition, minimize the mean-squared error (MSE) between the recovered signal and the reference signal without constraint—such that SDR is sacrificed for the sake of minimum MSE. Equivalently, the Wiener filter minimizes the total distortion between the output of the processed, noisy input and the reference input speech.

The array was mounted on the driver's-side visor of car. The impulse responses were measured, with loudspeaker, from the approximate position of the driver's mouth; the $T_{60}$ time of the car is approximately 50 ms. Noise was recorded in the car, on a highway, at speeds of around 50 mph (80 kph). Speech from a human speaker, seated in the driver's seat, was recorded while the car was stationary and turned off. By separating the speech recording from the highway-noise recording and adding them together, the $SIR_G$ and SDR performance measures in expressions (26) and (27) could be estimated; however, the accuracy of these measures depends on a minimal or nonexistent amount of non-speech sounds present in the speech recording. Informal listening indicates that the speech has very little noise contamination.

The MKDR and MKWE techniques were tested in varying noise levels by scaling the recorded highway noise and adding it to the recorded speech in seven tests, such that the maximum input signal-to-interference ratio (ISIR) over all microphones was −5, −2.5, 0, 2.5, 5, 7.5, and 10 dB after the pre-processing filter. First, a four-second block of the noisy signals were high-pass filtered with cutoff of 350 Hz to prevent bias in the results due to little speech content below 350 Hz. Then time-frequency distributions were computed by applying Hamming windows of length P=Q 512 to signal segments having an overlap of 0.75P samples (48 ms), and taking the zero-padded K-point fast Fourier transform of the windowed segment, where K=1024. The reference channel j was chosen to be the one with the highest input SIR. For the MKWE noise estimate, the $20^{th}$ percentile, bias-removing scale factors were calculated empirically from the noise-only signal. The frequency bin noise powers were then estimated from the $20^{th}$ percentiles of the noisy speech and the bias-removing scales factor applied.

Figure 7:
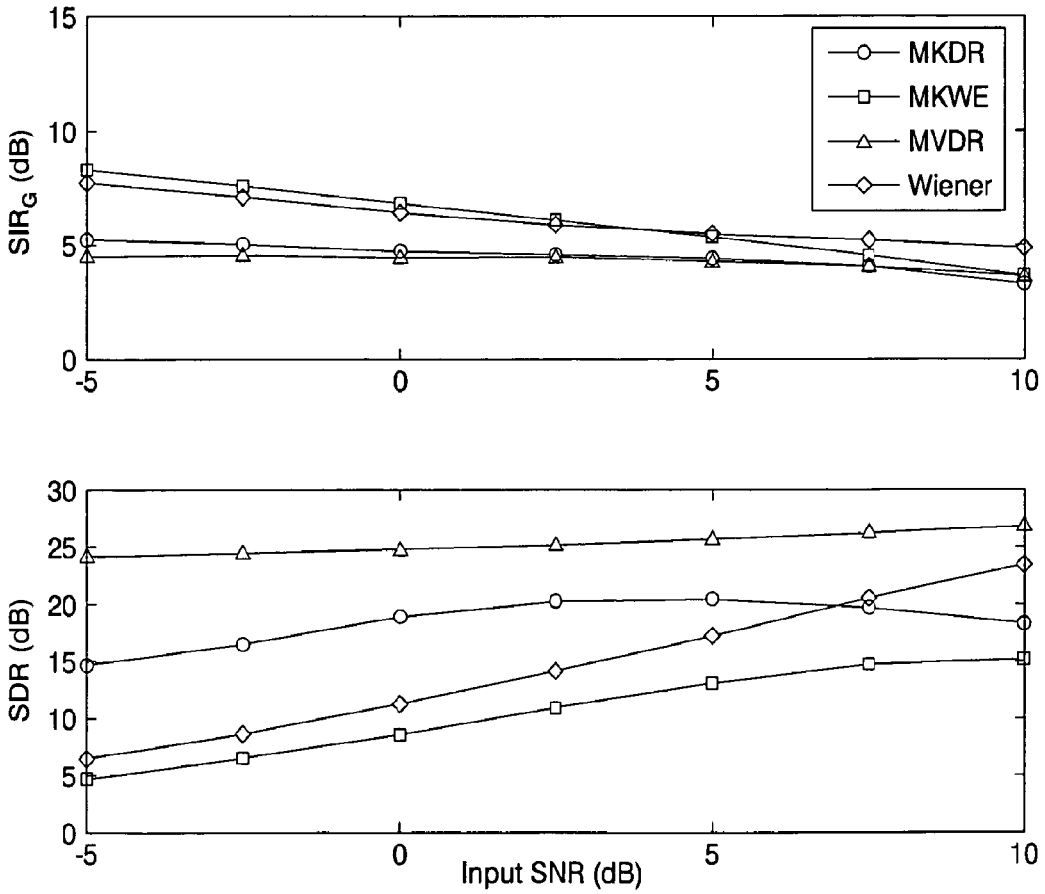
FIG. 7. illustrates beamformer performance for a human speaker in a car environment.

MKDR and MKWE recovery filters were computed and compared to the MVDR and Wiener techniques to the same data with the same parameters. Referring to FIG. 7, $SIR_G$ and SDR results (or a beamformer performance result) are shown for the car environment, with a human speaker in the driver's seat of the car, in 80 kph highway noise. The Wiener beamformer requires signal statistics, noise statistics, and speech-to-microphone responses, while the MVDR beamformer requires the speech-to-microphone responses. The MKDR beamformer infers the responses from the noisy microphone signals and implements MVDR beamformer. The MKWE beamformer relies on estimates of noise output to estimate the Wiener postfilter. Informal listening tests indicate no difference in intelligibility between the MKDR- and MVDR-processed outputs, nor the MKWE and Wiener outputs.

The Wiener technique provides the best $SIR_G$. The MKDR technique achieves the $SIR_G$ of MVDR and the MKWE technique achieves the $SIR_G$ of the Wiener approach, thus indicating that the MKDR and MKWE techniques sufficiently estimate the unknown-in-practice information that the MVDR and Wiener techniques require. In this car environment the MKDR technique provides gain of 3-5 dB and the MKWE technique gain of 3-8 dB; the similar performance of MVDR and Wiener (which have ground-truth knowledge) indicates the difficulty of recovering speech in the presence of highway noise. Despite the differences in SDR between the techniques, no appreciable difference in intelligibility or quality was noticed between MKDR and MVDR, nor between MKWE and Wiener. It should be appreciated comparable performance is observed despite the blind recovery approach of MKDR and MKWE relative to other techniques.

Figure 8:
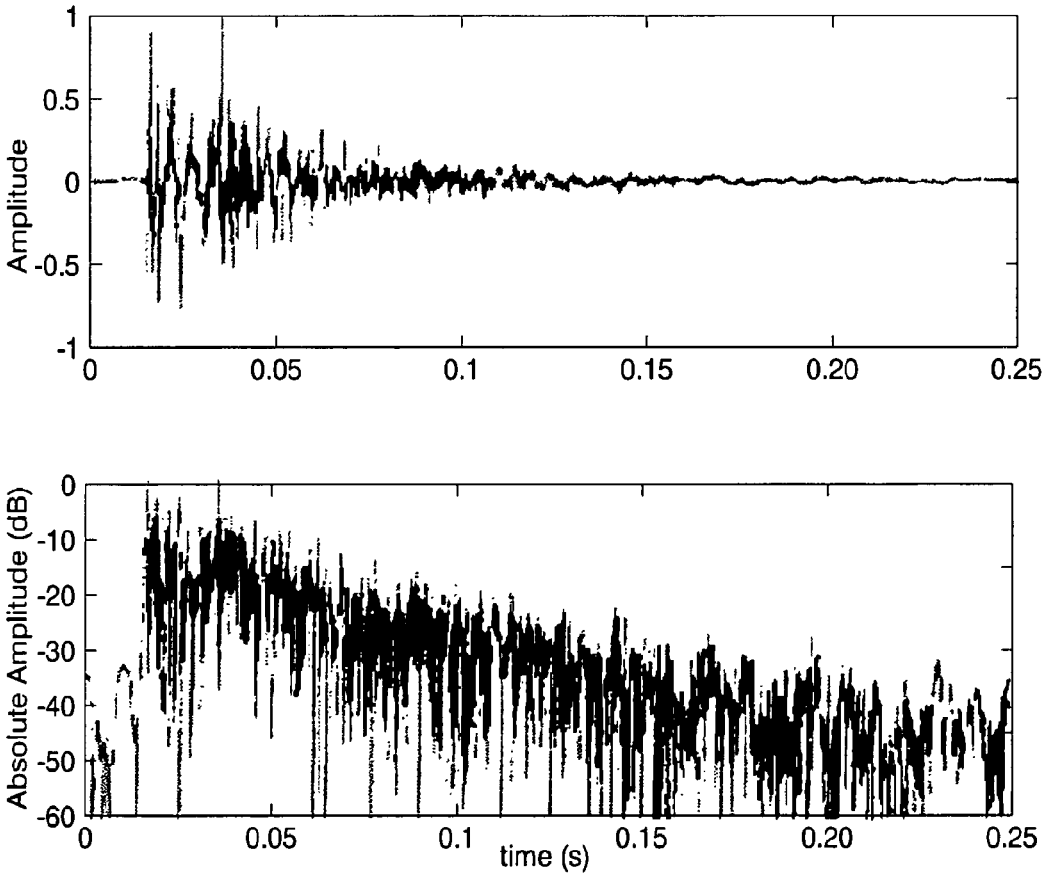
FIG. 8. illustrates an impulse response from a loudspeaker to a single array microphone.

The same array that was used in the car environment was also mounted against a wall, approximately 1.5 meters off of the floor in 9×6×2.75 reverberant room with $T_{60}$ time of approximately 300-340 ms. The impulse responses were measured with a loudspeaker from two positions, both at the approximate mouth height of a seated person (approximately 1.1 meters). These two cases are selected as representations of the best and worst source positions for noisy speech recovery in reverberant room. One position is approximately 2.1 meters away from and facing the array, and the other position is at the center of the room, approximately 5.2 meters away from and facing away from the array. The set of impulse responses most challenging for recovery is the latter. Because the speaker is far away and facing away from the array; strong, late reflections occur, a few even having equal magnitude to the direct-path sound. Referencing FIG. 8, an example is shown of an impulse response from a loudspeaker to a single array microphone, with the loudspeaker facing away from the microphone array at a distance of 5.2 meters.

Noise from different computers in the room was recorded, one at time, as was clock radio tuned to static noise, placed approximately 2.3 meters away from the array at a height of 2.1 meters. Speech from a seated human speaker, in the same two positions as the loudspeaker, was recorded with the computers and radio turned off. By separating the speech recording from the noise recordings and adding them together, the $SIR_G$ and SDR performance measures in expressions (26) and (27) could be estimated; however, the accuracy of these measures depends on the minimal or non-existent amount of non-speech sounds present in the speech recording. Informal listening indicates that the "clean" speech does have some stationary noise contamination, particularly in frequencies below 500 Hz. The stationary noise contamination may be due to factors such as noise outside of the room and/or lighting noise.

The MKDR and MKWE techniques were tested in varying noise levels by summing the computer and radio noise and adding a scaled version to the recorded speech in seven tests, such that the maximum input signal-to-interference ratio (ISIRs) over all microphones was −5, −2.5, 0, 2.5, 5, 7.5, and 10 dB after the pre-processing filter. First, a four-second block of the noisy signals were high-pass filtered with a cutoff frequency of 350 Hz to prevent bias in the results due to little speech content below 350 Hz. This filter also removes a significant portion of the contamination in the speech signal. Then time-frequency distributions were computed by applying Hamming windows of length P=Q=2048 to signal segments having an overlap of 0.75P samples (192 ms), and taking the zero-padded K-point fast Fourier transform of the windowed segment, where K=4096. The reference channel j is chosen to be the one with the highest input SIR. For the MKWE noise estimate, the $20^{th}$ percentile, bias-removing scale factors were calculated empirically from the noise-only signal. The frequency bin noise powers were then estimated from the $20^{th}$ percentiles of the noisy speech and the bias-removing scales factor applied.

Figure 9:
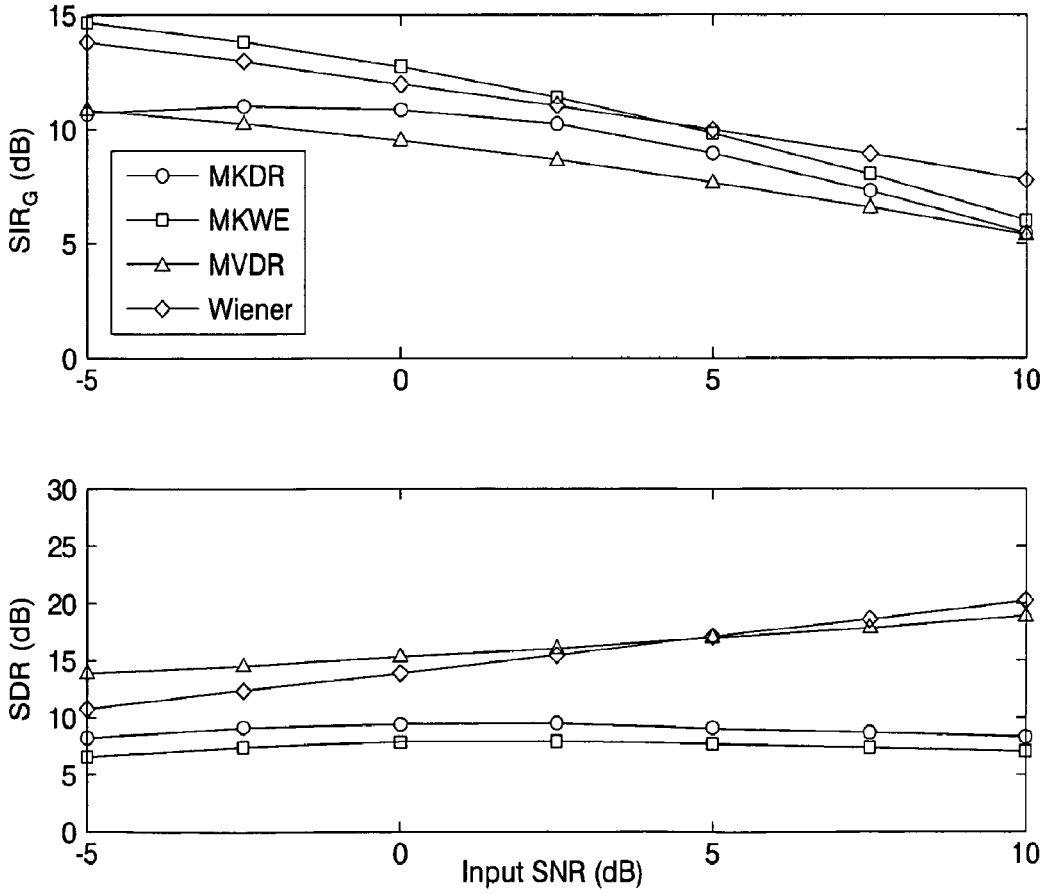
FIG. 9. illustrates beamformer performance for a human speaker facing away from a microphone array.
Figure 10:
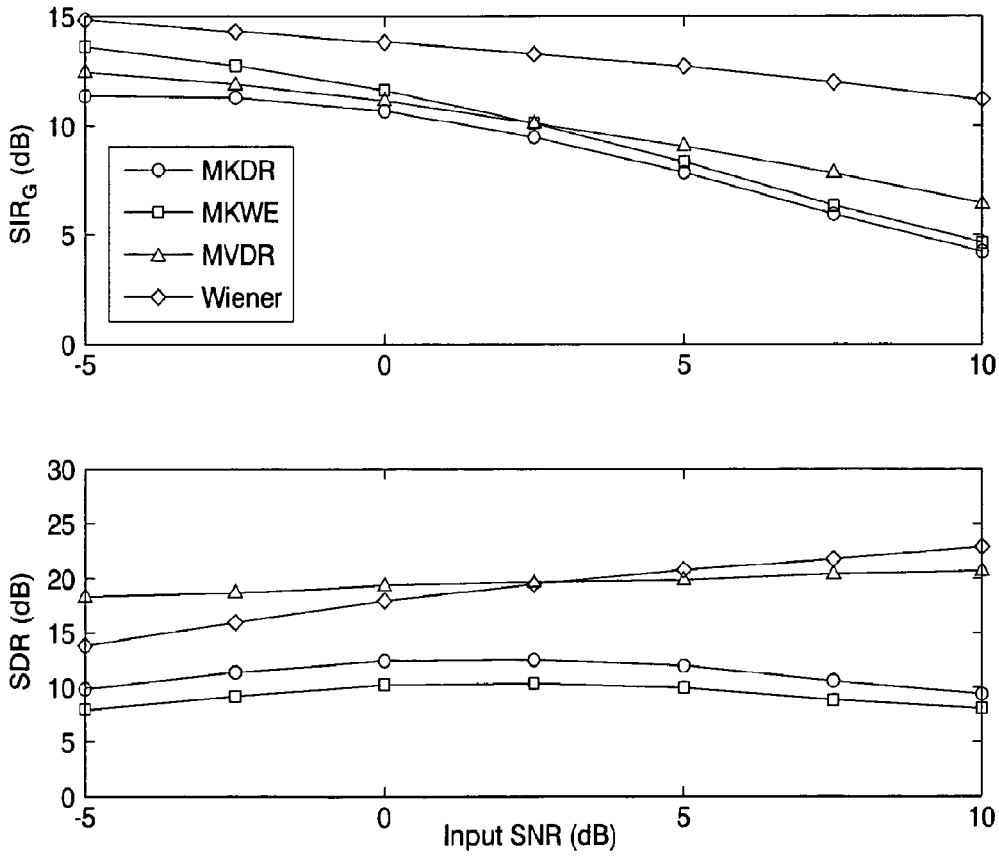
FIG. 10. illustrates beamformer performance for a human speaker facing a microphone array.

MKDR and MKWE recovery filters were computed and compared to the MVDR and Wiener techniques to the same data with the same parameters. Referencing FIGS. 9 and 10, $SIR_G$ and SDR for the two human-speaker positions in the reverberant room environment are shown. FIG. 9 represents beamformer performance for a human speaker facing away from the microphone array, 5.2 m away, in a mixture of radio static and computer noise. The Wiener beamformer requires signal statistics, noise statistics, and speech-to-microphone responses, while the MVDR beamformer requires the speech-to-microphone responses. The MKDR beamformer infers the responses from the noisy microphone signals and implements a MVDR beamformer. The MKWE beamformer relies on estimates of noise output to estimate the Wiener postfilter. Informal listening tests indicate no difference in intelligibility between the MKDR- and MVDR-processed outputs, nor the MKWE and Wiener outputs. FIG. 10 represents beamformer performance for a human speaker facing the microphone array, 2.3 m away, in a mixture of radio static and computer noise. The Wiener beamformer requires signal statistics, noise statistics, and speech-to-microphone responses, while the MVDR beamformer requires the speech-to-microphone responses. The MKDR beamformer infers the responses from the noisy microphone signals and implements a MVDR beamformer. The MKWE beamformer relies on estimates of noise output to estimate the Wiener postfilter. Informal listening tests indicate no difference in intelligibility between the MKDR- and MVDR-processed outputs, nor the MKWE and Wiener outputs.

The Wiener technique provides the best $SIR_G$, but it also requires the most information about the source and noise. For both speaker positions the MKDR technique achieves $SIR_G$ just above or below MVDR, thus indicating the MKDR is sufficiently estimating the unknown-in-practice steering vectors that MVDR requires. In both cases the MKDR provides good results for input SIRs below 10 dB; between 8 and 11 dB SIR gain is achieved at these moderate-to-low input SIRs. For the away-facing position, the MKWE technique achieves the $SIR_G$ of the Wiener technique at 7.5 dB input SIR and below, thus indicating the MKWE is sufficiently estimating the unknown-in-practice statistics that the Wiener technique requires. Below 7.5 dB input SIR, between about 8 and 15 dB SIR gain is achieved.

For the position facing the array, the MKWE doesn't provide any significant gain over the MVDR improvement, except at below-zero input SIRs. Note the SDR of the MKDR- and MKWE-filtered signals are lower than those of both the Wiener- and MVDR-filtered signals. Because stationary noise is present in the clean speech, the MVDR and Wiener filters will tend to preserve this noise, while the MKDR filters will tend to remove this "clean-speech noise", therefore lowering the MKDR and MKWE SDRs. Despite this noise-contamination, no appreciable difference in intelligibility was noticed between MKDR and MVDR, nor MKWE and Wiener, and the MKDR and MKWE-recovered speech did appear to lack the contamination noise that was present in the MVDR and Wiener recovered speech.

Noisy signals were recorded in an MRI machine using a dual-gradient, fiber-optic microphone. The test subject was asked to read sentences while the MRI machine was scanning his head. The noise produced is very challenging for speech recovery techniques because it is pulsed, with pitched sound having sound-pressure levels over 110 dB. Furthermore, the sound is non-stationary—it resonates in a cavity small enough that movement of the patient's mouth causes changes in the recorded noise.

The noisy signal was first processed with a filter that removed the 10 largest-amplitude frequencies of the signal with 10 notch filters. The frequencies were selected from the reference channel and the resulting filters are applied to both channels. The noise is challenging enough that significant noise energy is still present. First, a four-second block of the noisy signals was high-pass filtered with a cutoff frequency of 350 Hz to prevent bias in the results due to very little speech content below 350 Hz. Then time-frequency distributions were computed by applying Hamming windows of length P=Q=1024 to signal segments having an overlap of 0.75P samples (96 ms), and taking the zero-padded K-point fast Fourier transform of the windowed segment, where K=2048. For the MKWE noise estimate, the $20^{th}$ percentile, bias-removing scale factors were calculated empirically from an equally-long, noise-only portion of the signal preceding the convoluted noise and speech portion. The frequency bin noise powers were then estimated from the $20^{th}$ percentiles of the noisy speech and the bias-removing scales factor applied.

Figure 11:
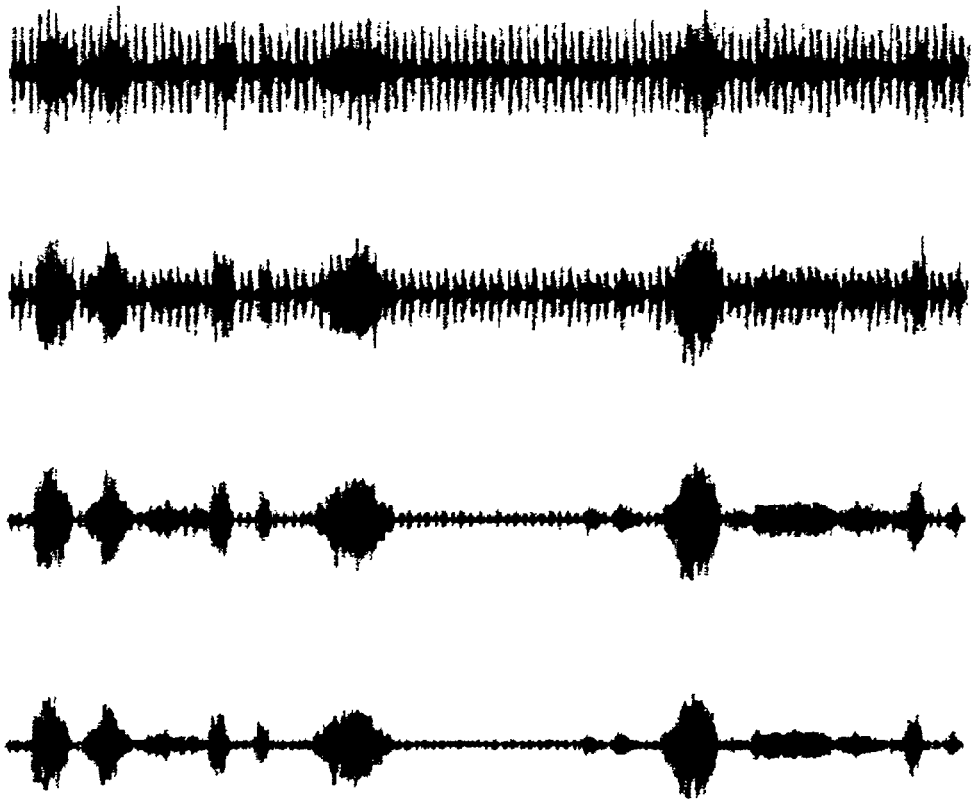
FIG. 11. illustrates beamformer performance for a human speaker in an MRI-machine noise environment.

The MKDR and MKWE techniques were applied to this notch-filtered, noisy signal in the MRI application as depicted in FIG. 11. Referring to FIG. 11, input signals shown in the top two waveforms are notch-filtered, respectively. The MKDR processed signal and MKWE (bottom) processed signal outputs are also shown in the bottom two waveforms of FIG. 11, respectively. The second input signal 504 has the higher input SIR, and is therefore selected as the reference signal.

The noise reduction via MKDR is estimated to be 10 dB over the notch-filtered signals by calculating the ratio of the power in an interference-only portion of the reference signal to the power in the same portion of the MKDR-processed signal. The MKWE MRI-machine noise reduction is estimated to be 15 dB via the same calculation. The noise pulses are significantly reduced, particularly in the MKWE output, resulting in speech that is less likely to fatigue the listener.

The minimum-kurtosis, distortionless-response (MKDR) and minimum-kurtosis, wiener estimate (MKWE) techniques are frequency-domain, multidimensional blind-source recovery techniques that recover reverberant speech in arbitrary lower-kurtosis noise in challenging, real-world environments. MKDR and MKWE are robust to microphone design and layout, and experiments using both gradient microphones and omni-directional microphones confirm such robustness. By maximizing the kurtosis of the output, SIR gains ranging from to 15 dB are achieved at moderate-to-low input SIRs in car and reverberant room, and these gains typically match the gains of the MVDR and MKWE techniques, which require ground-truth knowledge that is unknown in practice.

The MKDR and MKWE techniques are also promising in challenging noise that does not fit the noise model, such as MRI noise. The SIR gain performance of MKDR and MKWE, along with informal listening tests of recorded speech in recorded noise, confirms the ability of the proposed techniques to blindly recover single, interference-corrupted speech source in lower-kurtosis noise, even under conditions that are severely challenging to most blind-source-separation methods, such as highly reverberant, high-noise, far-field conditions.

Further exmples of experimental parameters for simulation purposes include:

Three-sensor linear array, omni mics 6 in. apart car: visor mount

30×20 ft reverberant room: wall mount, 4.5 ft. off floor

Real noise recorded in car (at 50 mph/80 kph) and room (computers and radio static)

Impulse responses (TR) measured in car ($T_{60}$≈ms, from driver's mouth) and room ($T_{60}$≈300 ms, 17 ft, seated, facing away)

Noise added to male TIMIT speaker filtered with impulse responses

Kurtosis algorithm applied using both environments with real noise and synthetic white noise 4 s segment, 8 kHz sampling rate, 200 Hz high-pass filter, hamming window, 75% overlap Car: 60 ms IR, 64 ms window, 128 ms FFTs Room; 156 ms IR, 256 ms window, 512 ms FFTs MVDR filter (known steering vectors applied) for reference

What is claimed is:

1. A method, comprising:

receiving a sound input with a plurality of sound input sensors, the sound input comprising a target signal from a source and noise from at least one interferer;

transforming the sound input into a frequency domain form represented by a plurality of different frequency bins;

determining a plurality of recovery-filter weight sets as a function of kurtosis, each recovery-filter weight set corresponding to one of the frequency bins;

determining a plurality of steering vectors, each steering vector corresponding to one of the frequency bins and one of the sound input sensors;

determining a plurality of beamformers according to the steering vectors and the recovery-filter weight sets, each beamformer corresponding to one of the frequency bins; and providing an output signal representative of the target signal as a function of the sound input and the beamformers, wherein the steering vector comprises:

$$e_{k,j} := \frac{E_m\left[X_k[m][T_k^*[m]]_j\right]}{\left[E_m\left[X_k[m][T_k^*[m]]_j\right]\right]_j};$$

wherein k is a frequency bin index, wherein m is a segment or frame index, wherein X is the sound input, wherein T is the frequency domain representation of the source, wherein Em is an expectation operator with respect to m, and wherein j is a sensor index.

2. The method of claim 1, further comprising:

applying a tapered window to each of the beamformers; and determining a plurality of scale factors, each scale factor corresponding to one of the frequency bins, and applying one of the scale factors to each of the beamformers.

3. The method of claim 2, wherein determining the plurality of scale factors further includes determining an average noise power value.

4. The method of claim 3, wherein determining the average noise power value comprises one of determining the average noise power value analytically and determining the average noise power value empirically.

5. The method of claim 1, wherein the target signal includes speech from the source that has a greater kurtosis than the at least one interferer.

6. The method of claim 5, wherein the source kurtosis $K(S_k[m])$ of the source comprises the value:

$$K(S_k[m]):=E_m\lfloor S_k|[m]|^4\rfloor-2E_m^2\lfloor|S_k[m]|^2\rfloor-|E_m[S_k^2[m]]|;$$

wherein S is the source signal, m is a segment or frame index, wherein k is a frequency bin index, and wherein $E_m$ is an expectation operator with respect to m.

7. The method of claim 1, further comprising applying a high-pass filter with a cutoff frequency below about 400 Hz to the sound input.

8. The method of claim 1, wherein the target signal includes speech from the source that has a greater kurtosis than the sound interfering with the speech.

9. An apparatus, comprising: a memory encoded with programming to perform the method of claim 1.

10. A method, comprising:

receiving a sound input with a plurality of sound input sensors, the sound input comprising a target signal from a source and noise from at least one interferer;

transforming the sound input into a frequency domain form represented by a plurality of different frequency bins;

determining a plurality of recovery-filter weight sets as a function of kurtosis, each recovery-filter weight set corresponding to one of the frequency bins;

determining a plurality of steering vectors, each steering vector corresponding to one of the frequency bins and one of the sound input sensors;

determining a plurality of beamformers according to the steering vectors and the recovery-filter weight sets, each beamformer corresponding to one of the frequency bins; and providing an output signal representative of the target signal as a function of the sound input and the beamformers, wherein determining a plurality of beamformers comprises constructing a plurality of Wiener filters:

$$V_{k,Wiener}=\hat{R}_{x_kx_k}^{-1}\frac{1}{M}\sum_{m=0}^{M-1}X_k[m][T_k^*[m]]_j;$$

wherein k is a frequency bin index, wherein m is a segment or frame index, wherein $\hat{R}_{x_kx_k}^{-1}$ is the recovery filter, wherein Xk is the sound input, wherein j is a sensor index, and wherein T is the frequency domain representation of the source, wherein the determining a plurality of beamformers according to the steering vectors and the recovery-filter weight sets comprises computing the beamformer from:

$$V_{k,Wiener}=V_{k,MVDR}=\frac{\hat{R}_{x_kx_k}^{-1}\hat{e}_{k,j}}{\hat{e}_{k,j}^H\hat{R}_{x_kx_k}^{-1}\hat{e}_{k,j}}\frac{1}{M}\sum_{m=0}^{M-1}X_k[m][T_k^*[m]]_j;$$

wherein $\hat{e}_{k,j}^H$ is a Hermitian transpose of a blind steering vector.

11. The method of claim 10, further comprising applying a scale factor to each Wiener filter, wherein each scale factor comprises:

$$\lambda(k)=\frac{\hat{\sigma}_{Y_{t,k}}^2}{\sigma_y^2}=1-\frac{\hat{\sigma}_{Y_{N,k}}^2}{\sigma_y^2};$$

wherein $\sigma_y^2$ is a power of signal y, and $\hat{\sigma}_{Y_{t,k}}^2$ is a blind power of the at least one interferer; and, further comprising determining adjusted windows according to:

$$[W_k']_i=\sum_{n=0}^{K-1}\beta(n)v_i'(n)e^{-j\frac{2\pi kn}{K}},$$

wherein $v_i'(n)$ is determined according to:

$$v_i'(n)=\sum_{k=0}^{K-1}\lambda(k)[V_k]_ie^{j\frac{2\pi kn}{K}};$$

wherein $[W_k']_i$ includes maximum kurtosis Wiener estimated filter values, wherein $\beta(n)$ is determined according to:

$$\beta(n)=\begin{cases}0.538-0.462\cos\left(\frac{2\pi n}{Q-1}\right) & n=0,\ldots,Q-1\\ 0 & n=Q,\ldots,K-1\end{cases},$$

and wherein K is the frequency bin index.

12. A method, comprising:

receiving a sound input including a combination of speech and sound interfering with the speech with a plurality to spaced-apart sound sensors;

determining a plurality of recovery-filter weights by modeling the speech with greater kurtosis than the sound interfering with the speech;

determining a plurality of steering vectors for the sound input sensors;

providing a plurality of beamformers according to the steering vectors and the recovery-filter weights; and providing an output signal representative of the speech with the beamformers, wherein a kurtosis $K(S_k[m])$ of the source comprises a value:

$$K(S_k[m]):=E_m\lfloor|S_k|[m]|^4\rfloor-2E_m^2\lfloor|S_k[m]|^2\rfloor-|E_m[S_k^2[m]]|;$$

wherein S is the source signal, m is a segment or frame index, wherein k is a frequency bin index, and wherein Em is an expectation operator with respect to m, wherein the steering vector comprises:

$$e_{k,j}:=\frac{E_m\left[X_k[m][T_k^*[m]]_j\right]}{\left[E_m\left[X_k[m][T_k^*[m]]_j\right]\right]_j};$$

wherein k is a frequency bin index, wherein m is a segment or frame index, wherein X is the sound input, wherein T is the frequency domain representation of the source, wherein Em is an expectation operator with respect to m, and wherein j is a sensor index, wherein the determining of a plurality of beamformers comprises constructing a plurality of Wiener filters:

$$V_{k,Wiener}=\hat{R}_{x_kx_k}^{-1}\frac{1}{M}\sum_{m=0}^{M-1}X_k[m][T_k^*[m]]_j;$$

wherein k is a frequency bin index, wherein m is a segment or frame index, wherein $\hat{R}_{x_kx_k}^{-1}$ is the recovery filter, wherein Xk is the sound input, wherein j is a sensor index, and wherein T is the frequency domain representation of the source.

13. The method of claim 12, which includes:

applying a tapered window to each of the beamformers; and determining a plurality of scale factors, each scale factor corresponding to one of the frequency bins, and applying one of the scale factors to each of the beamformers.

14. The method of claim 12, wherein the determining a plurality of beamformers according to the steering vectors and the recovery-filter weight sets comprises computing the beamformer from:

$$V_{k,Wiener}=V_{k,MVDR}=\frac{\hat{R}_{x_kx_k}^{-1}\hat{e}_{k,j}}{\hat{e}_{k,j}^H\hat{R}_{X_kX_k}^{-1}\hat{e}_{k,j}}\frac{1}{M}\sum_{m=0}^{M-1}X_k[m][T_k^*[m]]_j;$$

wherein $\hat{e}_{k,j}^H$ is a Hermitian transpose of a blind steering vector.

15. A method, comprising:

receiving a sound input including a combination of speech and sound interfering with the speech with a plurality to spaced-apart sound sensors;

processing the sound input to separate the speech from the sound interfering with the speech based on a degree of kurtosis of the speech greater than the sound interfering with the speech; and establishing a plurality of beamformers with the processing to generate an output signal representative of the speech;

determining a plurality of steering vectors for the sound input sensors; and providing the beamformers as a function of the steering vectors, wherein the steering vector comprises:

$$e_{k,j}:=\frac{E_m\left[X_k[m][T_k^*[m]]_j\right]}{\left[E_m\left[X_k[m][T_k^*[m]]_j\right]\right]_j};$$

wherein k is a frequency bin index, wherein m is a segment or frame index, wherein X is the sound input, wherein T is the frequency domain representation of the source, wherein Em is an expectation operator with respect to m, and wherein j is a sensor index.

16. The method of claim 15, wherein the processing includes:

transforming the sound input into a frequency domain form with a number of different frequency bins; and determining a different set of the recovery-filter weights for each of the frequency bins.

17. The method of claim 15, which includes blindly estimating the speech based on the kurtosis of the sound input.

18. The method of claim 15, wherein the sound input is received from an occupant in a vehicle and which includes wirelessly communicating the sound input.

19. The method of claim 15, wherein the sound input is received from a patient in a magnetic resonance imaging (MRI) machine.

20. The method of claim 15, wherein the sound input is received from a participant in a teleconference.

21. A system, comprising:

a sound input comprising a source and at least one interferer;

at least one sound sensor structured to receive the sound input and to convert the sound input into a computer readable sound signal;

a processing subsystem including a controller, the controller structured to:

interpret the computer readable sound signal;

divide the computer readable sound signal into a plurality of frequency bins;

determine a plurality of recovery-filter weight sets as a function of signal kurtosis and a plurality of steering vectors in correspondence to the frequency bins;

determine a plurality of beamformers according to the steering vectors and the recovery-filter weight sets, each beamformer corresponding to one of the frequency bins;

establish an output signal as a function of the computer readable sound signal and the beamformers; and an output device structured to provide the primary signal, wherein the steering vector comprises:

$$e_{k,j}:=\frac{E_m\left[X_k[m][T_k^*[m]]_j\right]}{\left[E_m\left[X_k[m][T_k^*[m]]_j\right]\right]_j};$$

wherein k is a frequency bin index, wherein m is a segment or frame index, wherein X is the sound input, wherein T is the frequency domain representation of the source, wherein Em is an expectation operator with respect to m, and wherein j is a sensor index.

22. The system of claim 21, wherein the controller includes means for applying a tapered window to each of the beamformers.

23. The system of claim 21, wherein the source exhibits a higher kurtosis value than the at least one interferer and the controller includes means for determining the recovery-filter weight sets as a function of kurtosis of the sound input.

24. The system of claim 21, further comprising a mobile vehicle, wherein the source comprises a sound from a human within the mobile vehicle, and wherein the at least one sound sensor comprises a microphone acoustically coupled to a passenger compartment of the mobile vehicle.

25. The system of claim 21, further comprising a hands-free communication subsystem including the at least one sound sensor, the processing subsystem, and the output device.

26. The system of claim 21, wherein the computer readable signal comprises a signal selected from the group consisting of an electronic signal, a datalink communication, and an optical signal.

27. The system of claim 21, further comprising a magnetic image resonance (MRI) machine, a patient communication subsystem structured for use with a patient positioned at least partially in the MRI machine, the patient communication subsystem including the at least one sound sensor, the processing subsystem, and the output device.

28. The system of claim 21, wherein the output device comprises a device selected from the group consisting of a memory storage device, an electro-magnetic transmitter, a computer network communication device, and an acoustic transmitter.

29. An apparatus, comprising: a communication system responsive to a sound input comprised of a speech source and at least one interferer, the system including:

means for receiving the sound input;

means for transforming the sound input into the frequency domain as a function of a plurality of different frequencies;

means for processing the sound input in the frequency domain at each of the different frequencies, the processing means including means for establishing a plurality of different speech recovery weight sets as a function of kurtosis of the sound input in correspondence to the different frequencies and means for determining a respective one of a plurality of different beamformers with the filter weight sets in correspondence to the different frequencies and a steering vector; and means for providing a speech output signal representative of the speech source with the beamformers, wherein the steering vector comprises:

$$e_{k,j} := \frac{E_m\left[X_k[m][T_k^*[m]]_j\right]}{\left[E_m\left[X_k[m][T_k^*[m]]_j\right]\right]_j};$$

wherein k is a frequency bin index, wherein m is a segment or frame index, wherein X is the sound input, wherein T is the frequency domain representation of the source, wherein Em is an expectation operator with respect to m, and wherein j is a sensor index.

* * * * *